US006751896B2

(12) United States Patent
Underwood

(10) Patent No.: US 6,751,896 B2
(45) Date of Patent: Jun. 22, 2004

(54) COMBINATION BUCKET/BREAKER APPARATUS FOR EXCAVATOR BOOM STICK

(76) Inventor: Lowell Underwood, P.O. Box 520, Prosper, TX (US) 75078

( * ) Notice: Subject to any disclaimer, the term of this patent is extended or adjusted under 35 U.S.C. 154(b) by 0 days.

(21) Appl. No.: 10/150,057

(22) Filed: May 17, 2002

(65) Prior Publication Data

US 2002/0162251 A1 Nov. 7, 2002

Related U.S. Application Data

(63) Continuation-in-part of application No. 09/624,099, filed on Jul. 24, 2000, now Pat. No. 6,430,849.

(51) Int. Cl.[7] ..... E02F 3/96
(52) U.S. Cl. ..... 37/403; 37/903
(58) Field of Search ..... 37/403, 468, 404–410, 37/903, 347, 352–362

(56) References Cited

U.S. PATENT DOCUMENTS

| | | | | |
|---|---|---|---|---|
| 3,865,013 A | | 2/1975 | Mastaj | |
| 4,070,772 A | | 1/1978 | Motomura et al. | |
| 4,100,688 A | | 7/1978 | Grist | |
| 4,810,162 A | * | 3/1989 | Foster | 414/723 |
| 4,869,002 A | * | 9/1989 | Glenn | 37/117.5 |
| 5,277,264 A | | 1/1994 | Song et al. | |
| 5,373,652 A | * | 12/1994 | Olsson | 37/403 |
| 5,549,440 A | | 8/1996 | Cholakon et al. | |
| 5,689,905 A | | 11/1997 | Ibusuki | |
| 6,085,446 A | | 7/2000 | Posch | |
| 6,120,237 A | * | 9/2000 | Cummings et al. | 414/729 |
| 6,269,560 B1 | | 8/2001 | Pratt | |

OTHER PUBLICATIONS

Komatsu Mini–Excavator, PC03–2F brochure sheets (3 pages), dated Apr. 2000.

* cited by examiner

*Primary Examiner*—Christopher J. Novosad
(74) *Attorney, Agent, or Firm*—John G. Fisher; Storm & Hemingway, LLP

(57) ABSTRACT

An excavating machine, representatively a tracked excavator has a boom stick portion on which both an excavating bucket and a hydraulic breaker are mounted for hydraulically driven pivotal movement between first and second limit positions. The bucket may be operated independently of the breaker for digging operations. Similarly, the breaker may be operated independently of the bucket for refusal material-breaking operations. The same excavating machine may now use the bucket and breaker in a rapid and continuous exchange, to frequently remove small quantities of broken refuse material with the bucket, exposing the bucket and breaker to fresh refuse material. A deployment system is disclosed having a bracket for closely aligned pivotal support of both the breaker and a single hydraulic cylinder on a single bracket. An end stop and latching assembly are also disclosed to increase the control and reliability of the device. An extension stop is disclosed to stabilize the device during operation. A specially designed electrical and hydraulic circuit is provided which permits the positional control of both the bucket and the breaker with the same control device typically used to control the pivotal orientation of an excavating bucket.

28 Claims, 20 Drawing Sheets

COMBINATION BUCKET/BREAKER APPARATUS FOR EXCAVATOR BOOM STICK

CROSS REFERENCE TO RELATED APPLICATION

This application is a Continuation-in-part of U.S. application Ser. No. 09/624,099, filed Jul. 24, 2000 now U.S. Pat. No. 6,430,849.

BACKGROUND OF THE INVENTION

1. Technical Field

The present invention generally relates to a material handling apparatus and, in a preferred embodiment thereof, more particularly relates to an excavating apparatus, representatively a tracked excavator, having operatively attached to the stick portion of its boom a specially designed combination bucket and breaker structure which uniquely permits the excavator operator to selectively carry out either digging or refusal material breaking tasks without having to change out equipment on the stick.

2. Description of Related Art

Large scale earth excavation operations are typically performed using a powered excavating apparatus, such as a tracked excavator, having an articulated, hydraulically pivotable boom structure with an elongated, pivotal outer end portion commonly referred to as a "stick ". Secured to the outer end of the stick is an excavating bucket which is hydraulically pivotable relative to the stick between "closed" and "open" positions. By pivotally manipulating the stick, with the bucket swung to a selected operating position, the excavator operator uses the bucket to forcibly dig into the ground, scoop up a quantity of dirt, and move the scooped up dirt quantity to another location, such as into the bed of an appropriately positioned dump truck.

A common occurrence during this conventional digging operation is that the bucket strikes refusal material (in excavation parlance, a material which "refuses" to be dug up) such as rock which simply cannot be broken and scooped up by the bucket. When this occurs it is typical practice to stop the digging operation, remove the bucket from the stick, and install a hydraulically operated "breaker" on the outer end of the stick in place of the removed bucket. The breaker has, on its outer end, an oscillating tool portion which rapidly hammers the refusal material in a manner breaking it up into portions which can be subsequently dug up. After the breaker has been utilized to break up the refusal material, the operator removes the breaker from the stick, replaces the breaker with the previously removed bucket, and resumes the digging operation with the bucket.

While this procedure is easy to describe, it is a difficult, laborious and time-consuming task for the operator to actually carry out due to the great size and weight of both the bucket and breaker which must be attached to and then removed from the stick, and the necessity for the operator to climb into and out of the high cab area of the excavator (often in inclement weather) to effect each bucket and breaker changeout on the stick. This sequence of bucket/breaker/bucket changeout, of course, must be laboriously repeated each time a significant refusal area is encountered in the overall digging process.

A previously utilized alternative to this single excavator sequence is to simply provide two excavators for each digging project—one excavator having a bucket attached to its boom stick, and the second excavator having a breaker attached to its boom stick. When the bucket-equipped excavator encounters refusal material during the digging process, it is simply moved away from the digging site, and the operator climbs down from the bucket-equipped excavator, walks over to and climbs up into the breaker-equipped excavator, drives the breaker-equipped excavator to the digging site, and breaks up the encountered refusal material. Reversing the process, the operator then switches to the bucket-equipped excavator and resumes the digging process to scoop up the now broken-up refusal material.

While this digging/breaking technique is easier on the operator, it is necessary to dedicate two large and costly excavators to a given digging task, thereby substantially increasing the total cost of a given excavation task. A modification of this technique is to use two operators—one to operate the bucket-equipped excavator, and one to operate the breaker-equipped excavator. This, of course, undesirably increases both the manpower and equipment cost for a given excavation project.

Another attempt to solve this problem is disclosed in U.S. Pat. Nos. 6,085,446 and 4,100,688 for an excavating machine having a motorized milling tool attached to the back of the bucket. A primary disadvantage of these devices is complexity, cost, and reliability. Another disadvantage is the weight that must be continuously carried by the bucket. The additional weight substantially reduces the carrying capacity and mobility of the bucket. Another disadvantage to the device of U.S. Pat. No. 6,085,446 is that the back of the bucket cannot be used to smooth or pad the soil, as is a well-known practice in the industry. Another disadvantage is that surface rock is not subject to an overburden pressure, so it generally fails faster under compression and impact forces than by the shearing forces of a scrapping and gouging rotary drilling tool.

Another attempt to solve this problem is disclosed in U.S. Pat. No. 4,070,772 for an excavating machine having a hydraulic breaker housed inside, or on top of, the boom stick. A primary disadvantage of this device is that it is extremely complex and expensive. Another disadvantage of this device is that it cannot be retrofit to existing excavators. Another disadvantage of this device is that the size of the breaker is limited. Another disadvantage of this device is that the bucket must be fully stowed to access the breaker and vice versa, making simultaneous operation impractical.

A more recent attempt to solve this problem is disclosed in U.S. Pat. No. 5,689,905 for another excavating machine having a hydraulic breaker housed inside, or on top of, the boom stick. In this device, the chisel portion of the breaker is removed when not in use. A primary disadvantage of this device is that it fails to permit immediate, unassisted switching from breaker to bucket, and thus simultaneous operation is impossible. Another disadvantage of this device is that it requires manual handling of the extremely heavy chisel tool each time the operator desires to convert to a breaker or bucket operation. Another disadvantage of this device is that it is extremely complex and expensive. Another disadvantage of this device is that it cannot be retrofit to existing excavators.

As can be readily appreciated from the foregoing, a need exists for an improved technique for carrying out the requisite digging and refusal material-breaking portions of an overall excavation operation in a manner eliminating or at least substantially eliminating the above-mentioned problems, limitations and disadvantages commonly associated with conventional digging and breaking operations. It is to this need that the present invention is directed.

SUMMARY OF THE INVENTION

In carrying out principles of the present invention, in accordance with a preferred embodiment thereof, an excavating machine, representatively a tracked excavator, is provided with a specially designed pivotable boom stick assembly that includes a boom stick having first and second excavating tools secured thereto for movement relative to the boom stick. Illustratively, the first excavating tool is an excavating bucket secured to the boom stick for pivotal movement relative thereto between a first position and a second position, and the second tool is a breaker secured to the boom stick for pivotal movement relative thereto between a stowed position and an operative position.

A hydraulically operable drive apparatus is interconnected between the boom stick and the bucket and breaker and is useable to pivotally move the bucket between its first and second positions, and to pivotally move the breaker between its stowed and operative positions. Representatively, the drive apparatus includes a plurality of hydraulic cylinder assemblies operatively interconnected between the boom stick and the bucket and breaker.

The bucket, when the breaker is in its stowed position, is movable by the drive apparatus to the second bucket position and is useable in conjunction with the boom stick, and independently of the breaker, to perform a digging operation. The breaker, when the bucket is in its first position, is movable by the drive apparatus to the breaker's operative position and is useable in conjunction with the boom stick, and independently of the bucket, to perform a breaking operation. Accordingly, the excavating machine may be advantageously utilized to perform both digging and breaking operations without equipment changeout on the boom stick.

Another advantage of the present invention is that the bucket can be operated without fully stowing the breaker. Likewise, the breaker may be operated without the necessity to fully extend the bucket. This increases the efficiency of the excavation process by providing immediate access to each of the tools, without delay. Another advantage of this capability is that it further increases the efficiency of the excavation process by rendering the bucket available to frequently scrape away the freshly generated cuttings so the breaker tool is always exposed to fresh refusal material, avoiding operation against previously generated cuttings. Another advantage of this capability is that by avoiding operation against previously generated cuttings, the breaker tool will last longer.

In an illustrated preferred embodiment thereof, the excavating machine is also provided with control circuitry coupled to the drive apparatus and useable to operate it. Representatively, the control circuitry includes a hydraulic flow circuit in which the drive apparatus is interposed; a flow controller operative to electively reverse the direction of hydraulic fluid flow through a portion of the hydraulic flow circuit; a diverting valve apparatus interconnected in the hydraulic flow circuit and operable to selectively route hydraulic fluid through the hydraulic flow circuit to (1) a first portion of the drive apparatus associated with the bucket, or (2) a second portion of the drive apparatus associated with the breaker; and a switch structure useable to selectively operate the diverting valve apparatus.

In another illustrated preferred embodiment of the present invention, a breaker and deployment system is disclosed, having a mounting bracket attached to the underside and lower end of the boom stick. A breaker is pivotally attached to a first pivot on the bracket. In the preferred embodiment, the first pivot is bifurcated. A hydraulic cylinder is pivotally attached at a second pivot on the bracket, in close proximity to the first pivot. The hydraulic cylinder is pivotally attached to the breaker at a third pivot. This embodiment has the advantage of requiring only one hydraulic cylinder. This embodiment has the additional advantage of using a much shorter hydraulic cylinder. This embodiment has the additional advantage of rapid deployment and retraction of the breaker. This embodiment has the additional advantage of a more stable and durable assembly during use. This embodiment has the additional advantage of being much easier and faster to install or remove. This embodiment has the additional advantages of being less expensive to manufacture, install, and service. This embodiment has the additional advantage of resulting in an increased range of motion of the deployed tool. This embodiment has the additional advantage of providing protection for the hydraulic cylinder when the tool is deployed and operational. This embodiment has the additional advantage of resulting in a less obstructive configuration of the hydraulic cylinder in relation to the boom stick when deployed.

In another illustrated preferred embodiment of the present invention, a bracket is attached to the inside and lower end of the boom stick. A breaker is pivotally attached to a first pivot on the bracket. A latch-lock assembly is mounted to, and between, the boom stick and the breaker. This embodiment has the advantage of preventing undesired, partial deployment of the breaker from the vibration and impact forces encountered during operation of the bucket. In a preferred embodiment, the latch-lock assembly comprises a slide latch located in a guide box attached to the boom stick for latching engagement with a strike attached to the breaker assembly. In another preferred embodiment, the latch-lock assembly comprises a ball latch attached to the boom stick for latching engagement with a strike ball attached to the breaker assembly.

In another illustrated preferred embodiment of the present invention, a shock absorbing retraction stop is attached to the boom stick. This prevents damage to the breaker and the boom stick when the breaker is in the stowed position, encountering vibration and impact forces during operation of the bucket.

In another illustrated preferred embodiment of the present invention, a bracket is attached to the underside and lower end of the boom stick. A breaker is pivotally attached to a first pivot on the bracket. Deployment of the breaker is made by the force of gravity acting on the breaker, upon release of the latch-lock assembly. In this embodiment, a controllable hydraulic cylinder is unnecessary to forcibly move the breaker. The breaker may be stowed by retracting the bucket into the breaker, thus forcing it upwards and against the boom stick until the latch-lock assembly can be engaged to secure the breaker in place. This embodiment has the advantage of being easily retrofit onto excavating machines without modification of the hydraulic system. An additional advantage of this embodiment is the lower cost of materials and installation. Optional to this embodiment, an uncontrolled hydraulic or pneumatic cylinder may be used to prevent free fall of the breaker upon release of the latch-lock. An advantage of this embodiment is increased safety.

In another illustrated preferred embodiment of the present invention, a bracket is attached to the underside and lower end of the boom stick. An extension stop is attached to the bracket, engageable with the breaker. One advantage of this embodiment is that it adds to the operator's control of the breaker tool. Another advantage of this embodiment is that the extension stop transmits a component of the impact force from the breaker directly to the boom stick, which reduces the reaction forces on the hydraulic cylinder, thus extending the life of the hydraulic cylinder. Another advantage of this embodiment is that the extension stop prevents over-extension of the breaker away from the boom stick, which has been shown to result in damage to the hydraulic cylinder used to deploy the breaker. Another advantage of this embodiment is that it is also useful in the gravity deployment embodiment disclosed above and elsewhere herein, to prevent excessive movement of the breaker during operation.

DETAILED DESCRIPTION OF THE INVENTION

Figure 1:
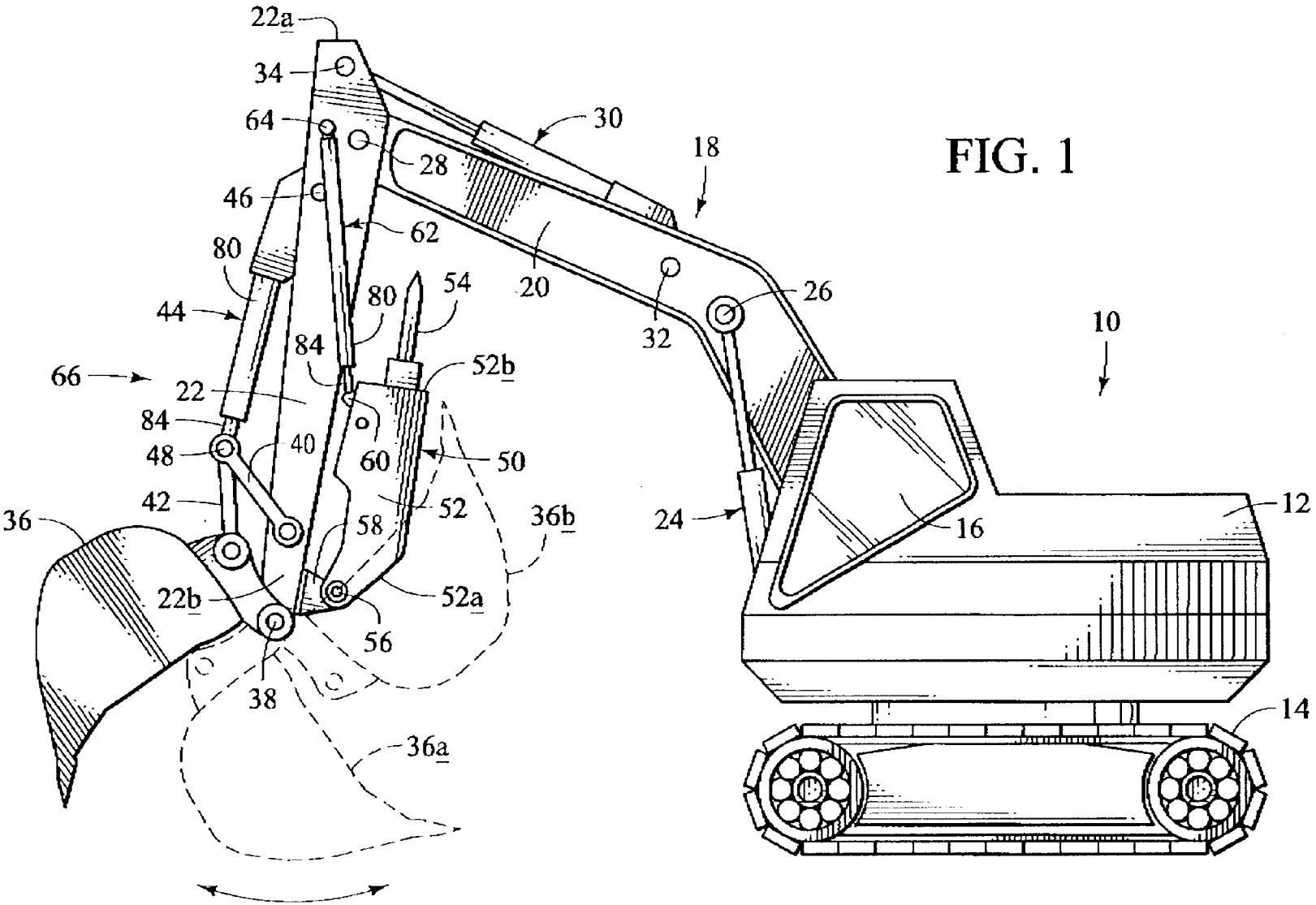
FIGS. 1 and 2 are simplified, somewhat schematic side elevational views of a representative excavating machine illustrating the variable positioning available for a bucket and breaker simultaneously carried by the stick portion of its boom.
Figure 2:
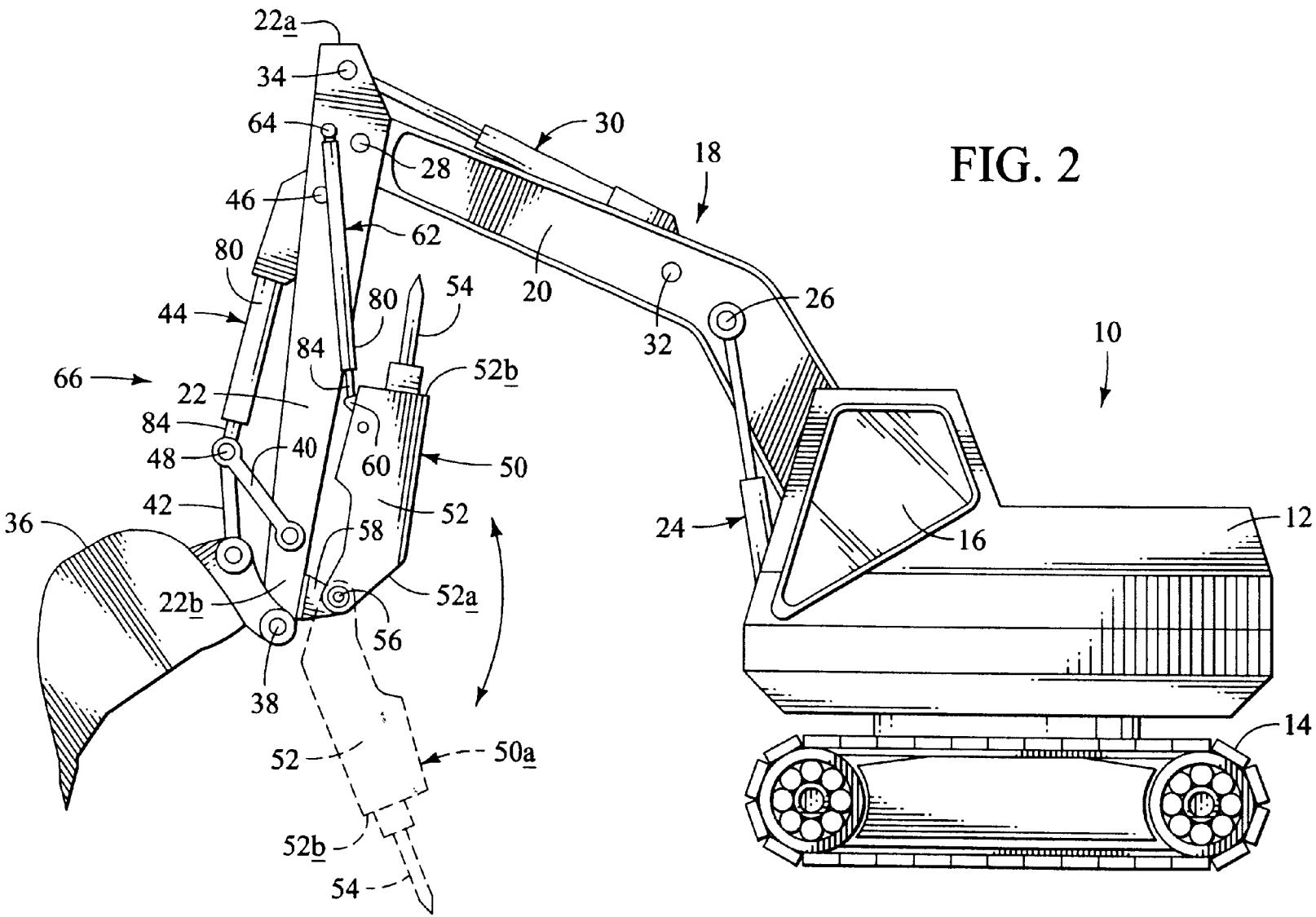

Illustrated in simplified form in FIGS. 1 and 2 is an earth excavating machine which is representatively in the form of a tracked excavator 10 having a body portion 12 supported atop a wheeled drive track section 14 and having an operator cab area 16 at its front or left end. While a tracked excavator has been illustrated, it will be readily appreciated by those of skill in this particular art that the principles of the present invention, as later described herein, are equally applicable to other types of earth excavating machines including, but not limited to, a wheeled excavator and a rubber-tired backhoe. It is further understood that the invention may assume various orientations and step sequences, except where expressly specified to the contrary. It is also to be understood that the specific devices and processes illustrated in the attached drawings, and described in the following specification are simply exemplary embodiments of the inventive concepts defined in appended claims. Hence specific dimensions and other physical characteristics relating to the embodiments disclosed herein are not to be considered as limiting, unless the claims expressly state otherwise.

A conventional articulated boom structure 18 projects forwardly from excavator body portion 12 and includes an elongated base portion 20 and a stick portion 22. The right or inner end of boom base portion 20 is pivotally secured to body portion 12, adjacent the front end thereof, and boom base portion 20 is pivotable in a vertical plane, toward and away from the ground, by means of hydraulic cylinder assemblies 24 (only one of which is visible in FIGS. 1 and 2) disposed on opposite sides of boom base portion 20 and interconnected between a pivot location (not visible) on excavator body portion 12 and a pivot location 26 on boom base portion 20.

Upper end 22*a* of boom stick 22 is connected to the left or outer end of boom base portion 20, at pivot location 28, and is forcibly pivotable in a vertical plane about pivot location 28, toward and away from the front end of the excavator body 12, by means of a hydraulic cylinder assembly 30 operatively interconnected between a pivot location 32 on boom base portion 20 and a pivot location 34 on the upper end 22*a* of boom stick 22.

A conventional excavating bucket 36 is pivotally secured to lower end 22*b* of stick 22, at pivot location 38, and is further secured to the lower end of stick 22 by a conventional pivotal drive bar linkage 40, 42. A hydraulic cylinder assembly 44 is pivotally interconnected between a pivot location 46 on upper end 22*a* of stick 22 and a pivot location 48 on drive bar linkage 40, 42. The hydraulic cylinder assembly 44 may be utilized to pivot bucket 36 relative to lower end 22*b* of stick, in a vertical plane toward and away from the front end of excavator body 12, between (1) a solid line, fully open position (see FIGS. 1 and 2) in which bucket 36 is disposed on the front side of stick 22 with its open side facing generally downwardly, and (2) a dotted line, fully closed position 36*b* (see FIG. 1) in which bucket 36 is disposed on the right side of stick 22 with its open side facing generally upwardly. And, of course, bucket 36 may be pivoted to a selected dotted line operating position 36*a* (see FIG. 1) somewhere between these two pivotal limit positions.

According to a key aspect of the present invention, a breaker 50 is mounted on stick 22 in addition to excavating bucket 36. In a manner subsequently described herein, this permits the same powered excavating apparatus 10 to uniquely perform both digging and breaking operations without the previous necessity of having to perform repeated tool changeouts on stick 22 or having to provide two separate powered excavating machines—one to dig and one to break.

Breaker 50 has a body section 52 with inner and outer ends 52*a* and 52*b*. Carried on the outer end 52*b* is an elongated, longitudinally reciprocable breaking tool 54 which is forcibly reciprocated in response to selective transmittal to breaker 50 of pressurized hydraulic fluid via suitable hydraulic lines (not shown). Inner breaker body end 52*a* is pivotally connected, at pivot location 56, to a suitable bracket 58 anchored to lower stick end 22*b* and projecting outwardly from its rear side. Outer breaker body end 52*b* is pivotally connected, at pivot location 60, to the rod ends of a pair of hydraulic cylinder assemblies 62 (only one of which is visible in FIGS. 1 and 2) pivotally connected at their opposite ends to upper stick end 22*a* at pivot location 64.

Hydraulic cylinder assemblies 62 are selectively operable, as later described herein, to forcibly pivot breaker 50 between (1) a solid line stowed or fully open position (see FIGS. 1 and 2) in which breaker body 52 extends upwardly along and generally parallel to the inner side of stick 22, with reciprocable breaker tool 54 positioned adjacent upper stick end 22*a*, and (2) a dotted line fully closed operational position 50*a* (see FIG. 2) in which the breaker body extends downwardly beyond lower stick end 22*b*, at an obtuse angle to the length of stick 22, with reciprocable breaker tool 54 pointing downwardly as viewed in FIG. 2. Of course, breaker 50 may also be positioned at any selected pivotal orientation between these two illustrated pivotal limit positions.

As can be seen by comparing FIGS. 1 and 2, with breaker 50 in its solid line stowed orientation (see FIGS. 1 and 2), bucket 36 may be freely pivoted between its solid and dotted line limit positions 36 and 36*b* (see FIG. 1), and used in digging operations, without interference from stowed breaker 50. Similarly, with bucket 36 in its fully open solid line pivotal orientation (see FIGS. 1 and 2), breaker 50 can be swung downwardly from its solid line stowed orientation (see FIGS. 1 and 2) to a selected dotted line operating orientation (see FIG. 2), and used to break up refusal material, without interference from bucket 36. Thus, either bucket 36 or breaker 50 may be used independently of the other without the necessity of excavation equipment changeout on boom stick 22.

The present invention thus provides an excavating machine or apparatus having a uniquely operative boom stick assembly 66 (see FIGS. 1 and 2) which includes stick 22, two independently operable excavation tools (representatively, excavating bucket 36 and breaker 50) each carried on the stick 22 for movement relative thereto between first and second limit positions, and drive apparatus (representatively the hydraulic cylinder assemblies 44, 62) interconnected between stick 22 and bucket 36 and breaker 50 and operable to variably position them relative to stick 22.

Using the representative excavating machine 10, a typical digging and breaking operation can be carried out as follows. With breaker 50 in its solid line stowed orientation (see FIGS. 1 and 2), and bucket 36 pivoted to a suitable operational orientation (for example, the dotted line orientation 36*a* shown in FIG. 1), the operator carries out a digging operation in a conventional manner. When refusal material, such as rock, is encountered and cannot be scooped up with bucket 36, the operator simply pivots bucket 36 back to its fully open, solid line position (see FIGS. 1 and 2), pivots breaker 50 away from its solid line stowed orientation (see FIGS. 1 and 2) to a selected operational orientation (for example, the dotted line orientation 50*a* shown in FIG. 2), and hydraulically operates breaker 50 to break up the refusal material.

After this breaking task is completed, the operator simply pivots deployed breaker 50 back to its solid line, stowed orientation (see FIG. 2), pivots bucket 36 away from its solid line fully open orientation (see FIG. 1) to a selected dotted line orientation, scoops up the now broken refusal material, and resumes the digging operation using bucket 36. Accordingly, both the digging and breaking portions of an overall excavation task may be performed by the machine operator without leaving cab area 16 or having to effect an equipment changeout on stick 22.

Figure 3A:
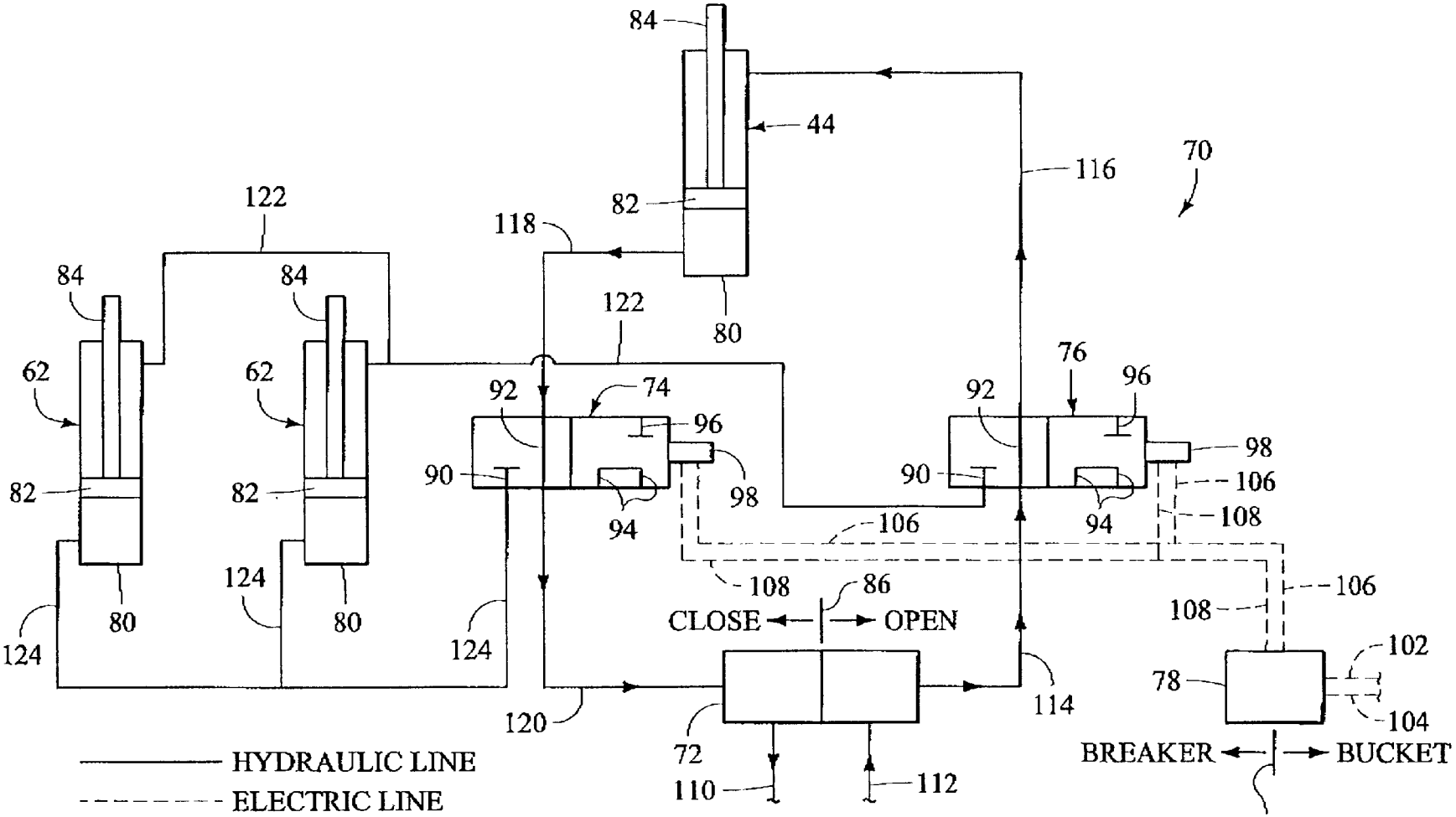
FIGS. 3A and 3B are schematic diagrams of a specially designed hydraulic and electrical circuit used to control the pivotal orientations of the bucket and breaker relative to the boom stick.
Figure 3B:
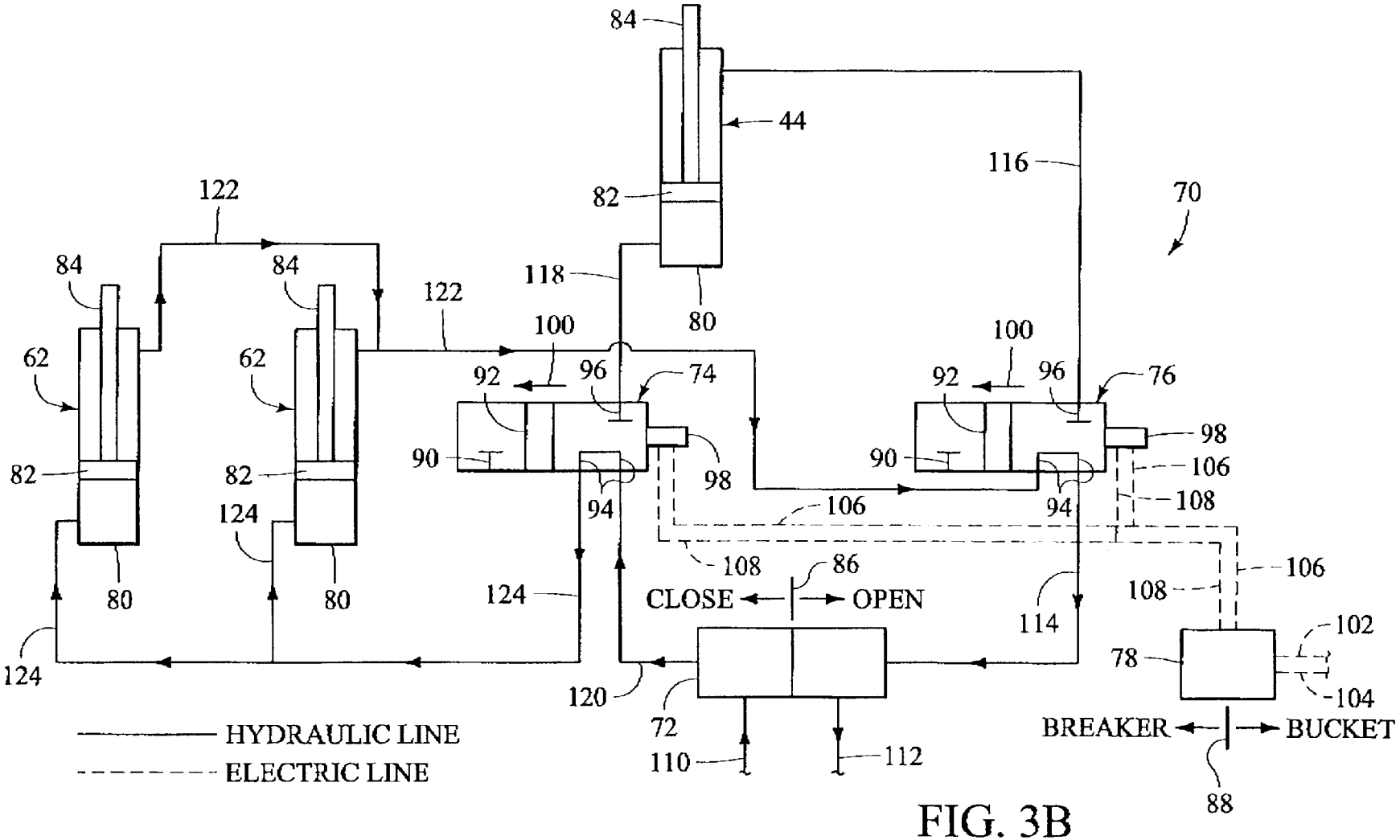

Schematically depicted in FIGS. 3A and 3B is a specially designed hydraulic/electric circuit 70 used to selectively pivot bucket 36 and breaker 50 between their previously described limit positions relative to stick 22. Circuit 70 includes bucket hydraulic cylinder assembly 44; breaker hydraulic cylinder assemblies 62; a manually operable hydraulic bucket/breaker pivotal position controller 72; a pair of solenoid operated hydraulic diverter valves 74, 76; and an electrical bucket/breaker selector switch 78.

Hydraulic cylinder assemblies 44 and 62 are of conventional construction, with each of them having a hollow cylinder 80, a piston 82 reciprocally mounted in the cylinder 80, and a rod 84 drivably connected to piston 82 and extending outwardly through an end of cylinder 80. Hydraulic bucket/breaker position controller 72 is appropriately positioned in cab area 16 and has a control member 86 that may be manually moved in the indicated "close" and "open" directions. Similarly, electrical bucket/breaker selector switch 78 is appropriately positioned in cab area 16 and has a switch member 88 that may be manually toggled to either a "breaker" position or a "bucket" position. Each of the hydraulic diverter valves 74, 76 has, from left to right as viewed in FIGS. 3A and 3B, a dead end port 90, a throughflow passage 92, an interconnected pair of turnaround ports 94, and a dead end port 96. Additionally, each valve 74, 76 has an electrical solenoid portion 98 operative as later described herein to shift the porting in its associated valve as schematically indicated by the arrows 100 in FIG. 3B.

DC electrical power supply lines 102, 104 are connected to the input side of bucket/breaker selector switch 78, and DC electrical control output lines 106, 108 are interconnected between the output side of switch 78 and valve solenoids 98. With selector switch member 88 toggled to its "bucket" position, no electrical power is supplied to solenoids 98, and ports and passages 90, 92, 94, 96 of hydraulic diverter valves 74, 76 are in their FIG. 3A orientations relative to the balance of schematically depicted circuit 70. When selector switch member 88 is toggled to its "breaker" position, DC electrical power is transmitted to the solenoids 98 via electrical lines 106 and 108 to thereby shift the valve porting leftwardly relative to the balance of circuit 70 as schematically indicated by arrows 100 in FIG. 3B.

With electrical switch member 88 in its "bucket" position, hydraulic cylinder assemblies 44 and 62, hydraulic position control 72, and hydraulic diverter valves 74 and 76 are hydraulically interconnected as follows as viewed in the schematic FIG. 3A circuit diagram.

Main hydraulic power lines 110, 112 are connected to the bottom side of position controller 72; hydraulic line 114 is interconnected between the right end of position controller 72 and through-flow passage 92 of diverter valve 76; hydraulic line 116 is interconnected between through-flow passage 92 of diverter valve 76 and the upper end of cylinder portion 82 of bucket hydraulic cylinder assembly 44; hydraulic line 118 is interconnected between the lower end of cylinder portion 82 of bucket hydraulic cylinder assembly 44 and through-flow passage 92 of diverter valve 74; and hydraulic line 120 is interconnected between through-flow passage 92 of diverter valve 74 and the left end of position controller 72. Hydraulic line 122 is interconnected between dead end port 90 of diverter valve 76 and the upper ends of cylinder portions 80 of breaker hydraulic cylinder assemblies 62; and hydraulic line 124 is interconnected between dead end port 90 of diverter valve 74 and the lower ends of cylinder portions 80 of breaker hydraulic cylinder assemblies 62.

Referring to FIG. 3A, with electrical selector switch member 88 toggled to its "bucket" position, position controller 72 is useable to control the pivotal orientation of bucket 36 relative to stick 22 (see FIG. 1) when breaker 50 is in its solid line stowed orientation. For example, when hydraulic control member 86 is moved toward the "open" position, hydraulic fluid is sequentially flowed (as indicated in the arrowed hydraulic portion of circuit 70 in FIG. 3A) through hydraulic lines 112 and 114, through-flow passage 92 of diverter valve 76, hydraulic line 116, the interior of cylinder portion 80 of bucket hydraulic cylinder assembly 44, hydraulic line 118, through-flow passage 92 of diverter valve 74, and hydraulic lines 120 and 110. This hydraulic flow retracts rod 84 of bucket hydraulic cylinder assembly 44 to thereby pivot bucket 36 in a clockwise direction away from its fully closed orientation 36*b* in FIG. 1. Conversely, when position control member 86 is shifted in a "close" direction, the hydraulic flow through this arrowed hydraulic portion of circuit 70 is reversed, thereby forcibly extending rod 84 of bucket hydraulic cylinder assembly 44 and pivoting bucket 36 in a counterclockwise direction toward its fully closed dotted line orientation 36*b* shown in FIG. 1.

Turning now to FIG. 3B, when it is desired to use breaker 50 instead of bucket 36, bucket 36 is pivoted to its fully open solid line position shown in FIG. 1, and electrical bucket/breaker switch member 88 is toggled to its "breaker" position to thereby supply electrical power, via leads 106 and 108, to solenoids 98 of hydraulic diverter valves 74, 76. This, in turn, causes the porting of valves 74, 76 to shift leftwardly (as viewed in FIG. 3B) as schematically indicated by arrows 100. After such port shifting (see FIG. 3B), hydraulic lines 120, 124 are coupled as shown to interconnected turnaround ports 94 in valve 74, and hydraulic lines 114, 122 are coupled to the interconnected turnaround ports 94 in valve 76.

Next, hydraulic control member 86 is moved in its "close" direction. In response, hydraulic fluid is sequentially flowed (as indicated in the arrowed hydraulic portion of the circuit 70 in FIG. 3B) through hydraulic lines 110 and 120, interconnected turnaround ports 94 in diverter valve 74, hydraulic line 124, the interiors of cylinder portions 80 of breaker hydraulic cylinder assemblies 62, hydraulic line 122, interconnected turnaround ports 94 in diverter valve 76, and hydraulic lines 114 and 112. This hydraulic flow forcibly extends rod portions 84 of breaker hydraulic cylinder assemblies 62 to thereby forcibly pivot the stowed breaker 50 (see FIG. 2) downwardly to a selected operating orientation such as dotted line position 50*a* in FIG. 2. The now operationally positioned breaker 50 may be hydraulically operated, to cause the reciprocation of its tool portion 54, using a conventional hydraulic breaker control (not shown) suitably disposed in cab area 16 of representative excavating apparatus 10. After breaker 50 has been used, the circuit 70 can be utilized to swing breaker 50 back up to its stowed orientation and then swing bucket 36 back down to a selected operational orientation thereof.

As will be readily appreciated by those of skill in this particular art, excavation apparatus 10 may be easily retrofit to provide it with both digging and breaking capabilities as previously described herein by simply connecting breaker 50 and its associated hydraulic drive cylinder apparatus 62 to stick 22, and modifying the existing bucket positional control circuitry (for example, as shown in FIGS. 3A and 3B) to add positional control capabilities for added breaker 50. In this regard it should be noted that position controller 72 shown in the circuit diagrams of FIGS. 3A and 3B may be existing bucket position controller. With the simple addition of diverter valves 74 and 76, bucket/breaker selector switch 78, and additional hydraulic lines, the operator can select and independently control both bucket 36 and breaker 50.

A variety of modifications may be made to the illustrated embodiment of the present invention without departing from the principles of such invention. For example, as previously mentioned, aspects of the invention can be advantageously utilized on a variety of types of excavating machines other than the representatively illustrated tracked excavator 10. Additionally, while hydraulic/electric circuit 70 permits the selected positional control of either bucket 36 or breaker 50, other types of control circuitry may be alternatively utilized, if desired, including separate hydraulic circuits for bucket and breaker. Moreover, while the independently utilizable tools mounted on stick 22 are representatively an excavating bucket and a breaker, other independently utilizable excavating tools could be mounted on stick in place of the illustrated bucket and breaker. Also, while the illustrated bucket and breaker are shown as being pivotally mounted to stick, the particular independently operable tools selected for mounting on stick could have alternate positional movements, such as translation, relative to boom stick on which they are mounted.

The foregoing detailed description is to be clearly understood as being given by way of illustration and example, the spirit and scope of the present invention being limited solely by the appended claims.

Figure 4:
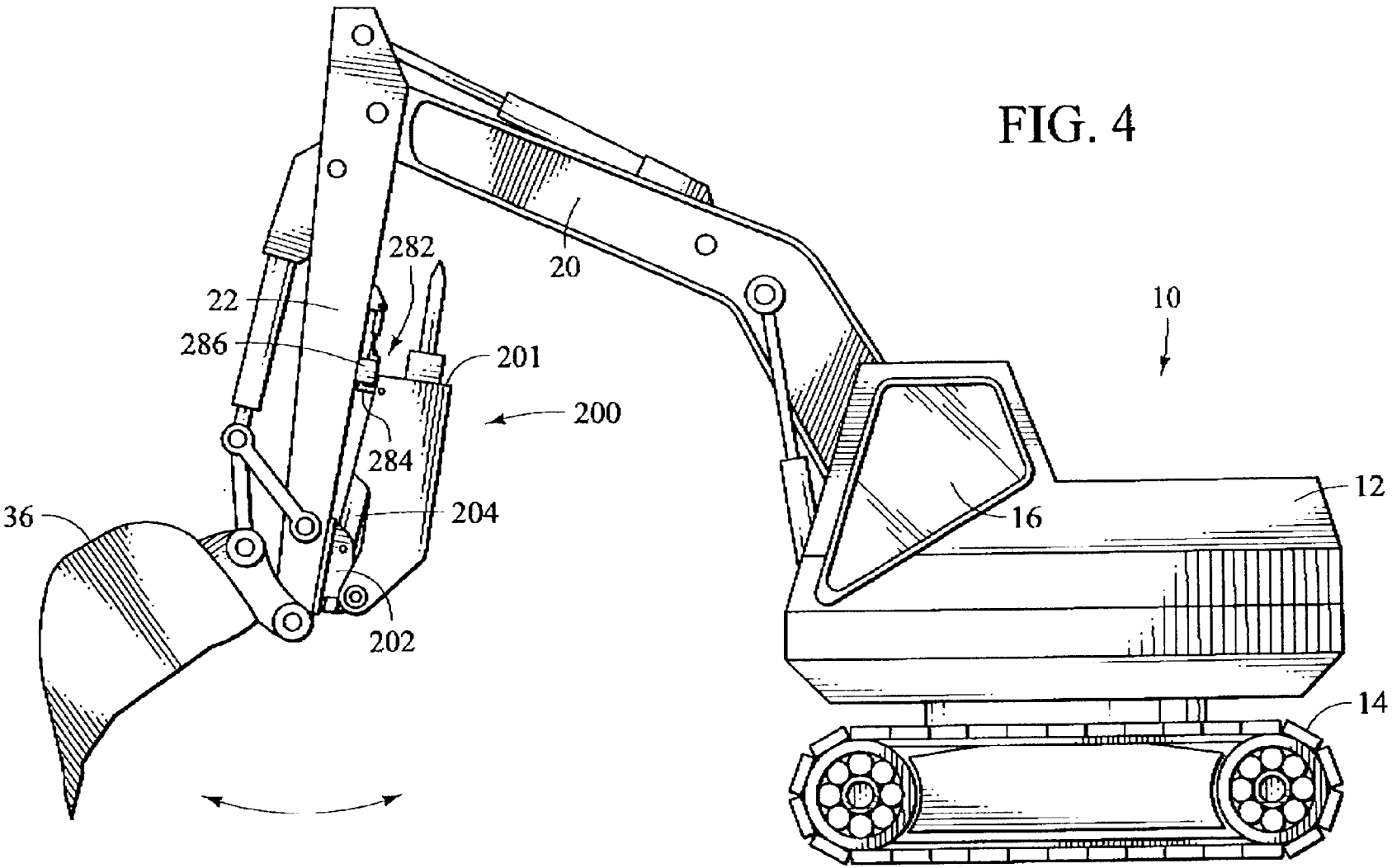
FIGS. 4, 5 and 6 are simplified, somewhat schematic side elevational views of a representative excavating machine, fitted with a preferred embodiment of a breaker and deployment system of the present invention. These figures illustrate the deployment of the breaker from the stowed position.

FIG. 4 discloses earth excavating machine 10 of FIG. 1 and FIG. 2, fitted with a preferred embodiment of an alternative and preferred breaker and deployment system 200 which is unique, and has numerous advantages. In this embodiment, a hydraulic breaker assembly 201 is mounted on boom stick 22 in addition to excavating bucket 36. A unitary bracket 202 is rigidly attached to stick 22 by welding or other means of secure attachment. Breaker assembly 201 is pivotally attached to bracket 202. A single hydraulic cylinder assembly 204 is pivotally attached at one end to bracket 202. Hydraulic cylinder assembly 204 is pivotally attached at its other end to breaker assembly 201. Thus, bracket 202 supports the entire deployment system of breaker assembly 201. The principle of the hydraulic operative control of breaker and deployment system 200 is identical to that disclosed above, except that single hydraulic cylinder 204 is operated for deployment and retraction of breaker assembly 201.

Figure 5:
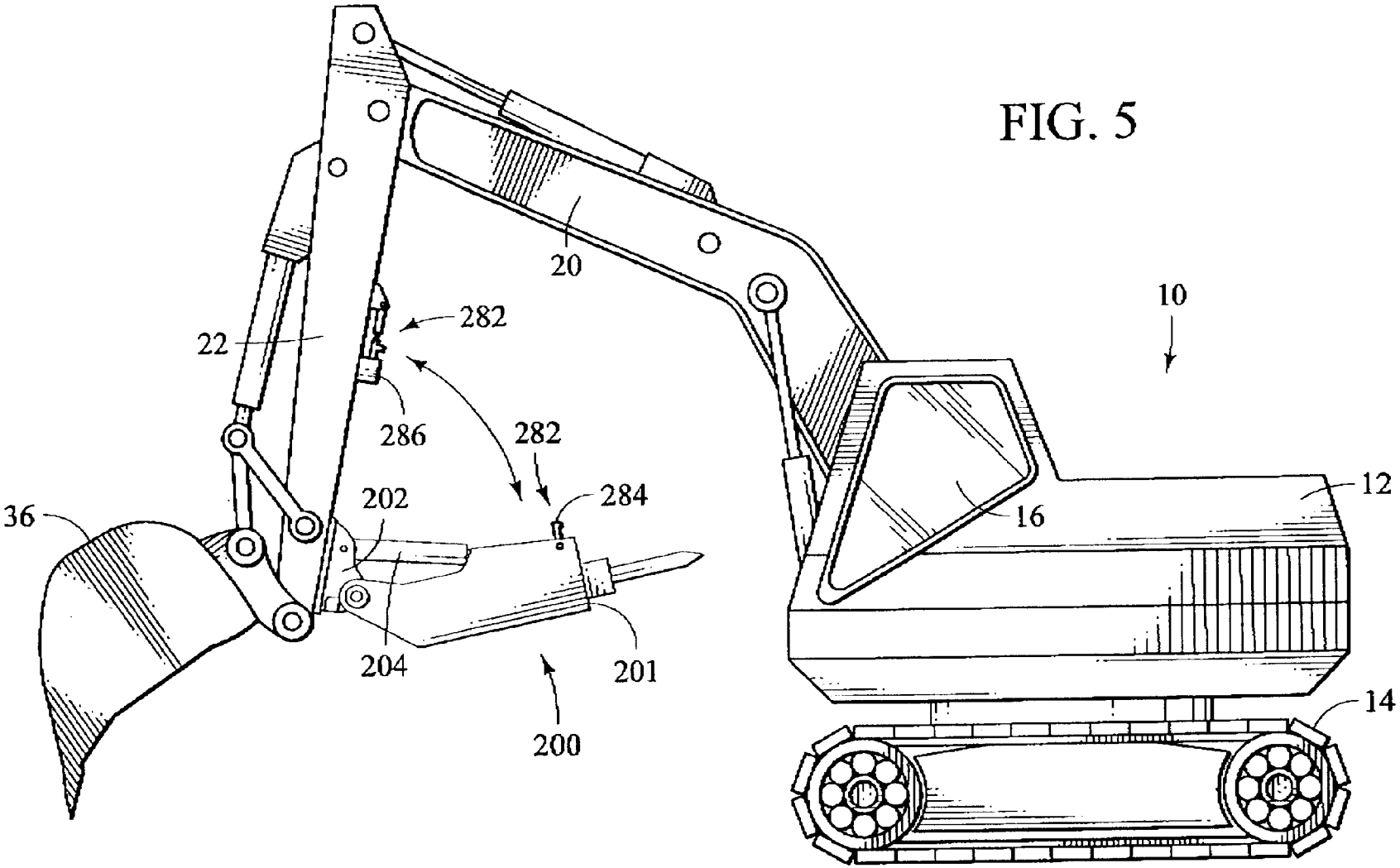

FIG. 5 illustrates earth excavating machine 10 fitted with breaker and deployment system 200 as in FIG. 4. In this figure, breaker assembly 201 is shown released and in a partially deployed position.

Figure 6:
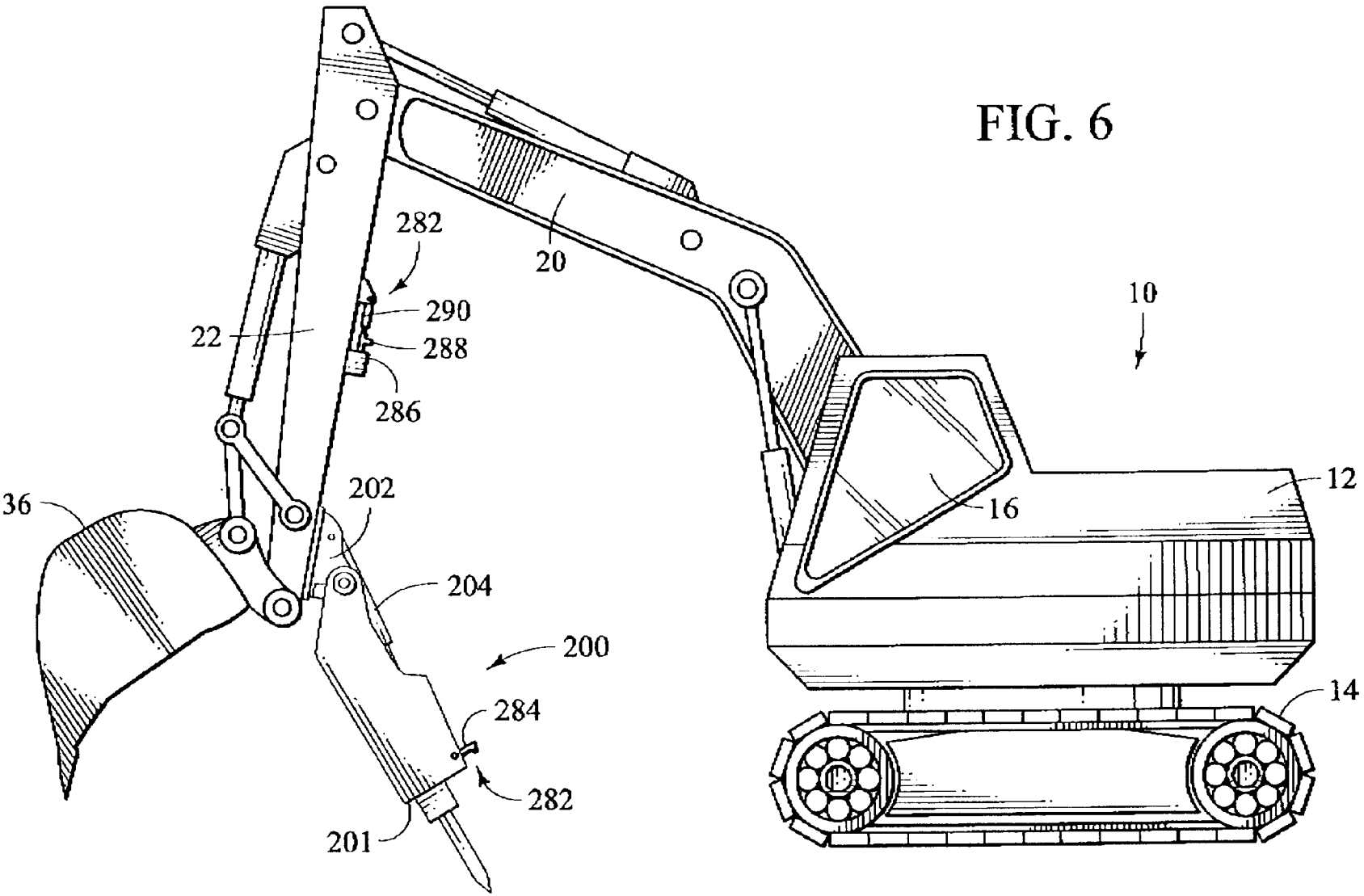

FIG. 6 illustrates earth excavating machine 10 fitted with breaker and deployment system 200 as in FIG. 4. In this figure, breaker assembly 201 is shown released and in a fully extended position. In this embodiment, breaker assembly 201 may be selectively positioned in any orientation between (and including) the fully deployed and fully retracted positions.

Figure 7:
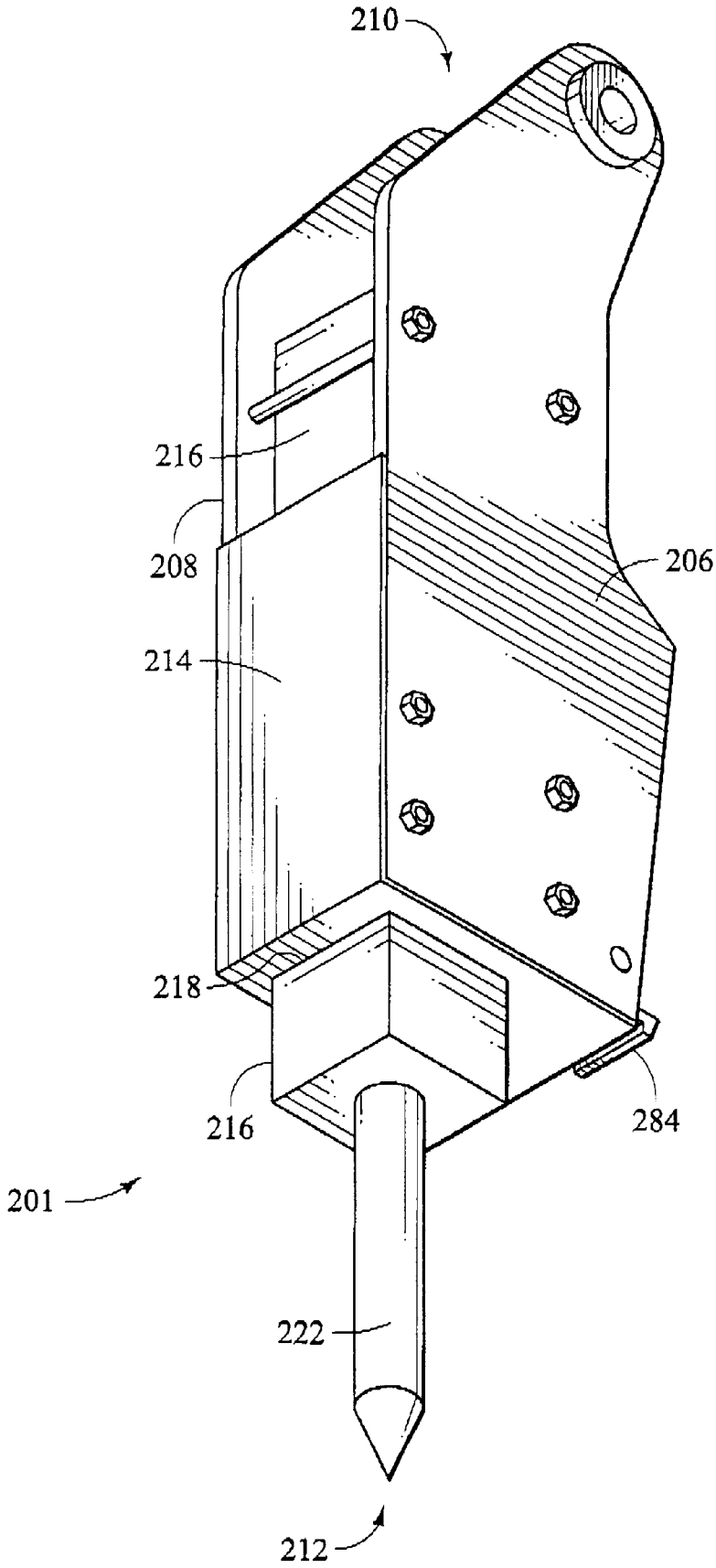
FIG. 7 is an isometric view of a preferred embodiment of a breaker portion of the breaker and deployment system of the present invention.

FIG. 7 is an isometric view of a preferred embodiment of breaker assembly 201 of the present invention. In this embodiment, breaker assembly 201 has a left body section 206 and an opposite right body section 208. Breaker assembly 201 has an inner end 210 and an opposite outer end 212. An optional cover plate 214 is attached between left body section 206 and right body section 208, over outer end 212. A conventional breaker tool 216 is secured between left body section 206 and right body section 208. Cover plate 214 has an opening 218, through which breaker tool 216 extends. Breaker tool 216 has an internal hydraulically operated cylinder 220 (not shown). A longitudinally reciprocating tool 222 is removably connectable to breaker tool 216. Reciprocating tool 222 forcibly reciprocates in response to selective transmittal of pressurized hydraulic fluid via suitable hydraulic lines (not shown) to internal hydraulic cylinder 220 of breaker tool 216.

Figure 8:
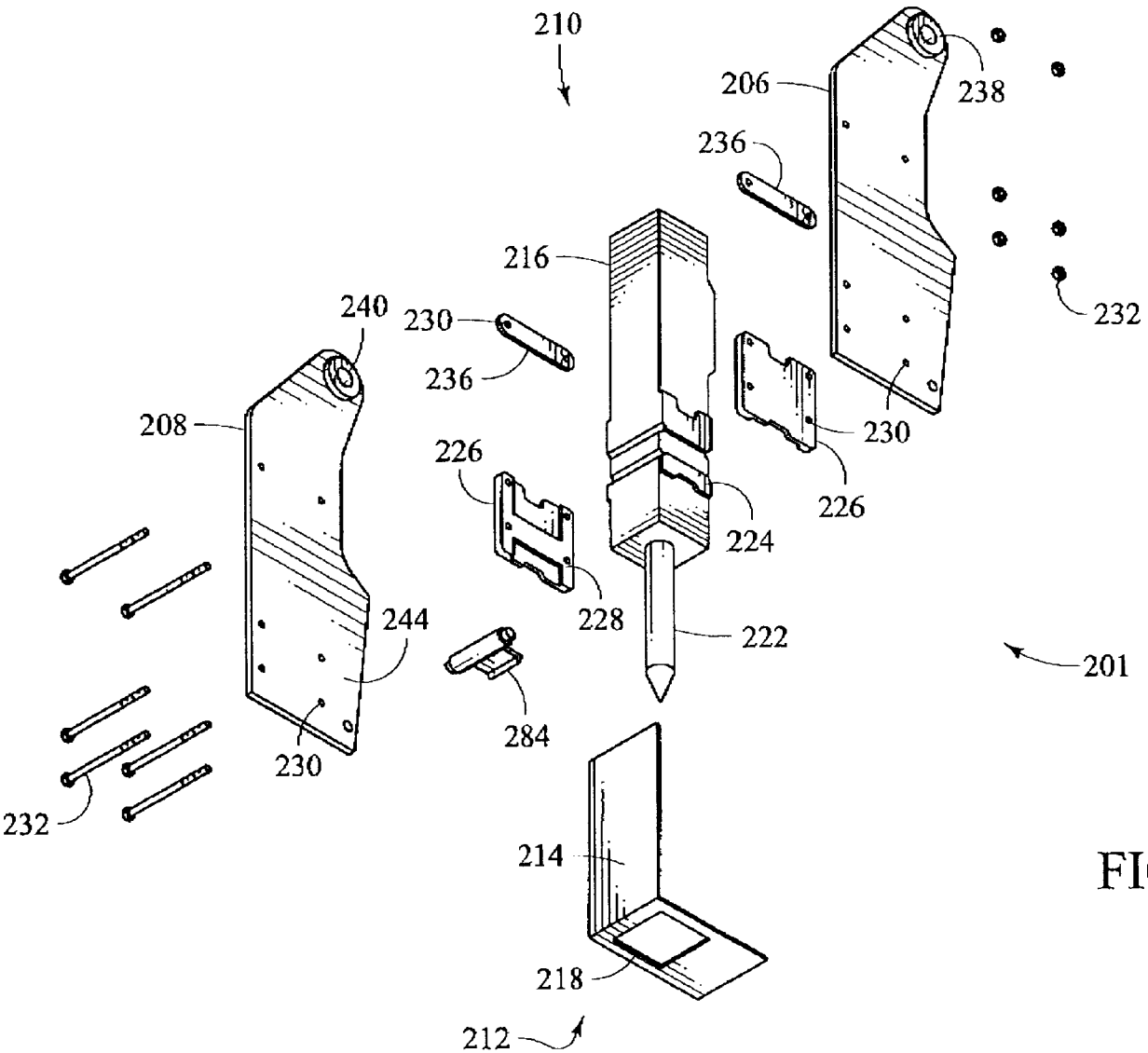
FIG. 8 is an exploded view of a preferred embodiment of a breaker portion of the breaker and deployment system of the present invention.

FIG. 8 is an exploded view of another preferred embodiment of breaker assembly 201. In this embodiment, a gripping structure 224 is located on breaker tool 216. A pair of lower lock plates 226 secures the outer end 212 of breaker tool 216 between left body section 206 and right body section 208. In another preferred embodiment, each lower lock plate 226 has a surface structure 228 for secured engagement with gripping structure 224 of breaker tool 216. Left body section 206, right body section 208, and lower lock plates 226, have matching hole patterns 230 receivable of a plurality of mechanical fastener assemblies 232.

A pair of upper lock plates 236 secures the inner end 210 of breaker tool 216 between left body section 206 and right body section 208. Left body section 206, right body section 208, and upper lock plates 236, have matching hole patterns 230 receivable of a plurality of mechanical fastener assemblies 232. In an alternative and equivalent embodiment (not shown) left body section 206 and right body section 208 are manufactured with the functional equivalent of lower lock plates 226 and upper lock plates 236 formed integrally on their inside surfaces.

Still referring to FIG. 8, left body section 206 has a first socket 238 and right body section 208 has a matching first socket 240 located near inner end 210 of breaker assembly 201. First sockets 238 and 240 are pivotally connectable to bracket 202.

Left body section 206 has a third socket 242 and right body section 208 has a matching third socket 244. A third pivot bushing 246 is attached in and between third sockets 242 and 244. Pivot bushing 246 is pivotally connectable to hydraulic cylinder assembly 204.

Figure 9:
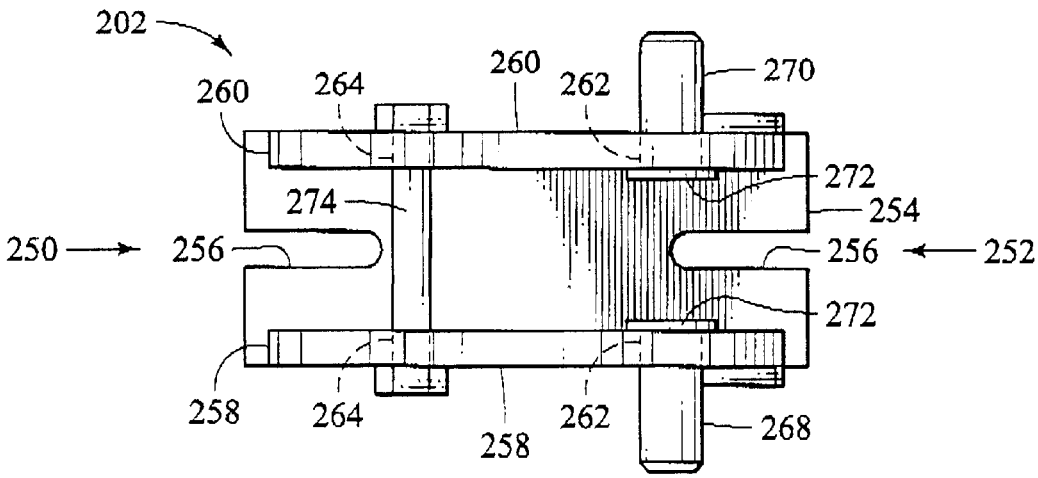
FIG. 9 is a top view of a preferred embodiment of the bracket of the present invention.
Figure 10:
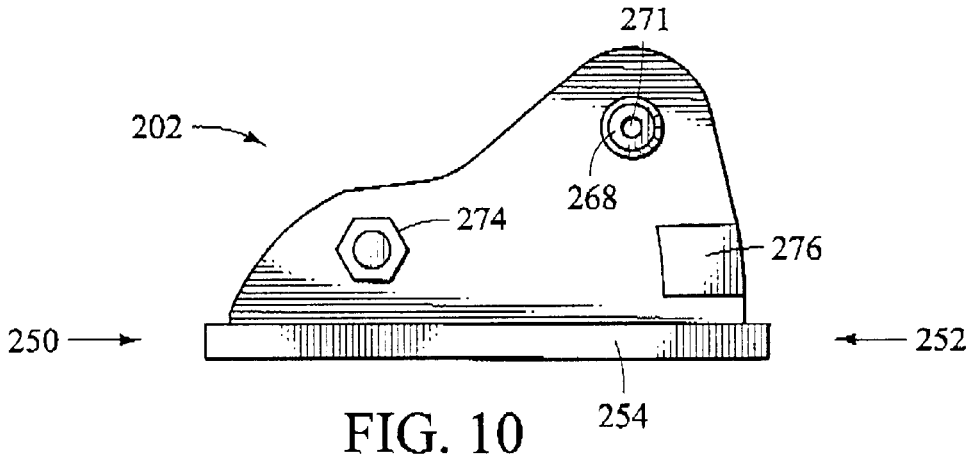
FIG. 10 is a side view of a preferred embodiment of the bracket of the present invention.

FIG. 9 is a top view of a preferred embodiment of bracket 202 of the present invention. FIG. 10 is a side view of bracket 202, and FIG. 9 is an isometric view of bracket 202. Referring to FIG. 9, bracket 202 has a low-end 250 and an opposite high-end 252. Bracket 202 has a base 254. In a preferred embodiment, a slotted portion 256 is located on base 254 at each of a low-end 250 and an opposite high-end 252.

Figure 11:
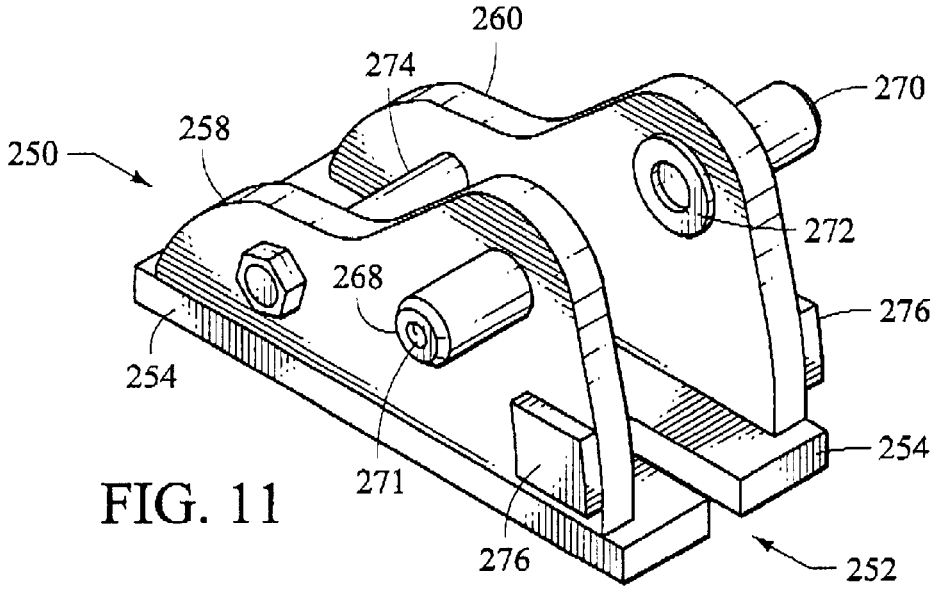
FIG. 11 is an isometric view of a preferred embodiment of the bracket of the present invention.

As best seen in FIG. 11, a left bracket side 258 and a right bracket side 260 extend upward from base 254 in substantially parallel relation to each other. Referring to FIG. 9, left bracket side 258 and right bracket side 260 each have a first socket 262 in substantial centerline alignment with each other. First socket 262 is located on high-end 252 of bracket 202. Left bracket side 258 and right bracket side 260 each have a second socket 264 in substantial centerline alignment with each other. Second socket 264 is located on low-end 250 of bracket 202.

In a preferred embodiment, bracket 202 has a bifurcated pivot means for pivotal attachment of breaker assembly 201 to bracket 202. In the embodiment disclosed in FIGS. 9, 10, and 11, the bifurcated pivot means comprises a left bushing 268 extending out of first socket 262 of left bracket side 258, and a right bushing 270 extending out of first socket 262 of right bracket side 260. It will be known by one of ordinary skill in the art, that there are other ways to achieve the disclosed configuration of bushings 268 and 270 extending from sides 258 and 260, without the necessity for first sockets 262, such as by external welding, casting of the bracket, and other means.

Figure 14:
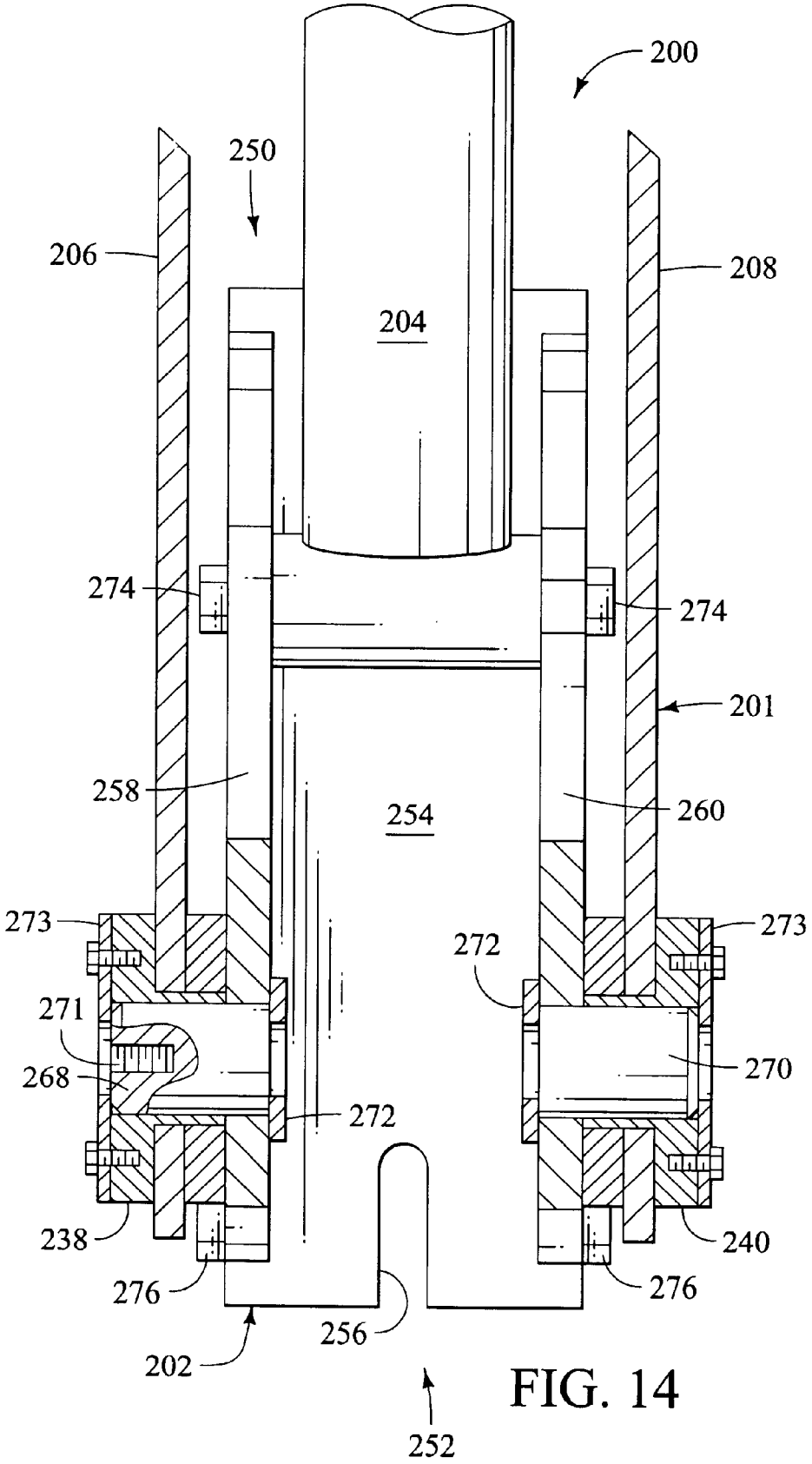
FIG. 14 is a bottom sectional view of a preferred embodiment of the breaker and deployment system of the present invention

In a preferred embodiment, best seen in FIG. 14, left bushing 268 and right bushing 270 are removably located in respective first sockets 262. In this embodiment, an optional bushing stop 272 is attached to the inside wall of each of left bracket side 258 and right bracket side 260. Also in this embodiment, each of left bushing 268 and right bushing 270 have an internal thread 271 to facilitate removal. Looking to FIG. 14, a removable bushing cap 273 may be attached, as by bolts or other means, to each of first socket 238 and 240 of left body section 206 and right body section 208 respectively. The removability of left bushing 268 and right bushing 270 permits easy removal of breaker assembly 201 without disassembly or removal of bracket 202.

In a less preferred embodiment, a first pivot bar 275 (not shown) extends through and between first socket 238 of left bracket side 258 and first socket 240 of right bracket side 260. While simpler in design, this configuration lacks a significant advantage of the disclosed bifurcated pivot means. As shown in greater detail below, the use of non-bifurcated pivot bar 274 presents a potential interfering obstacle for hydraulic cylinder assembly 204 when breaker assembly 201 is retracted.

Referring again to FIG. 9, a pivot bar 274 extends through and between second socket 264 of left bracket side 258 and second socket 264 of right bracket side 260. Pivot bar 274 provides pivotal connection of hydraulic cylinder assembly 204 to bracket 202.

In the preferred embodiment, left bushing 268 and right bushing 270 are located in closer proximity to high-end 252 than is pivot bar 274. Pivot bar 274 is located in closer proximity to base 254 than are left bushing 268 and right bushing 270.

In another preferred embodiment, an extension stop means limits the maximum extension of breaker assembly 201. In a preferred embodiment, the extension stop means is a mechanical interference between breaker assembly 201 and mounting plate In FIGS. 9, 10, and 11, the extension stop means disclosed comprises a pair of extension stops 276, attached, one each, to left bracket side 258 and right bracket side 260. In an equivalent alternative embodiment not shown, extension stops 276 are attached to base 254. One of ordinary skill in the art will understand that a variety of modifications may be made to the illustrated embodiment of the present invention without departing from the principles of such invention. For example, a single extension stop may by used.

Figure 12:
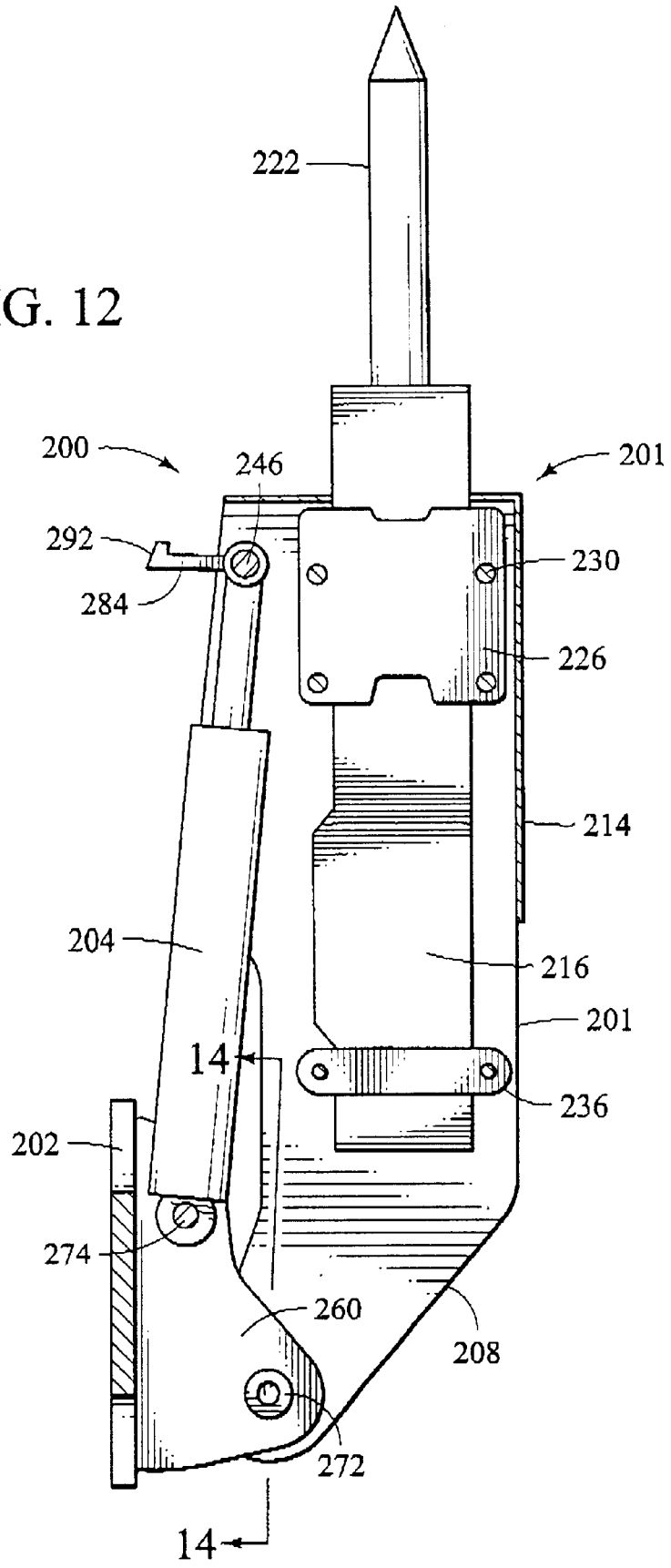
FIG. 12 is a side-sectional view of a preferred embodiment of the breaker and deployment system of the present invention.

FIG. 12 is a cross-sectional side view of a preferred embodiment of the breaker and deployment system 200 of the present invention. In this view it can be seen that breaker assembly 201 is pivotally attached to bracket 202, hydraulic cylinder assembly 204 is pivotally attached at one end to bracket 202, and hydraulic cylinder assembly 204 is pivotally attached at its other end to breaker assembly 201. Thus configured, a triangular relationship is formed between bushing 270, pivot bar 274, and pivot bushing 246. Operation (expansion) of hydraulic cylinder assembly 204 increases the length of one side of the triangle, causing angular rotation of breaker assembly 201 around bushing 270 (and bushing 268, not shown) and coincident deployment of breaker assembly 201 into operative position.

Figure 13:
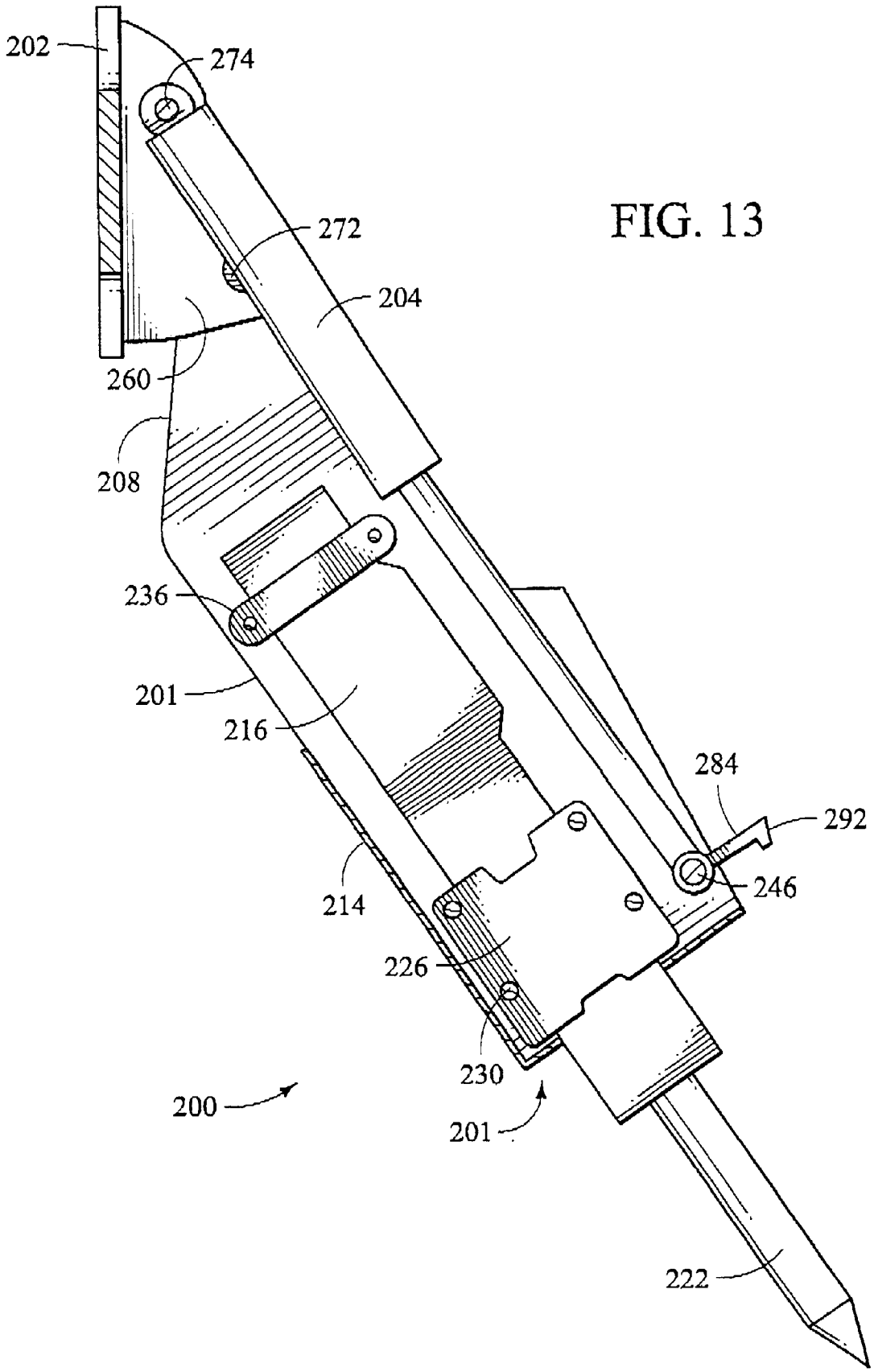
FIG. 13 is a side-sectional view of a preferred embodiment of the breaker and deployment system of FIG. 12, showing the breaker fully deployed.

FIG. 13 is a side-sectional view of a preferred embodiment of the breaker and deployment system of FIG. 12, showing the breaker fully deployed. In FIG. 13, the benefit of the bifurcated pivot means is clearly shown. In FIG. 13, breaker assembly 201 has been deployed to a point by which hydraulic cylinder 204 is aligned between the inside of left bushing 268 (not shown) and the inside of right bushing 270, as shown by the position of bushing stop 272. This positions reciprocating tool 222 closer to the vertical position, allowing the operator of excavating machine 10 to operate the tool at greater subsurface depths, and thus dramatically enhance the value of the breaker and deployment system.

In another embodiment of the present invention, a method of "Super-deployment" is disclosed. By this method, breaker assembly 201 may be deployed past the deployment angle permitted by full extension of hydraulic cylinder 204. To accomplish this, the operator takes the following steps:

1. Fully extend hydraulic cylinder 204;
2. momentarily disengages the power to hydraulic cylinder 204;
3. allow gravity to urge rotation of breaker assembly 201 a few degrees further;
4. initiate retraction of hydraulic cylinder 204, further extending the angular deployment of breaker assembly 201.

In this manner, the maximum deployment angle achieved is only limited by eventual mechanical interference with boom stick 22, or selective placement of extension stops 276.

FIG. 14 is a sectional view of breaker and deployment system 200 of a preferred embodiment with the section taken as shown in FIG. 12. In FIG. 14, the benefit of the bifurcated pivot means is again shown. In this figure, it is seen that left first socket 238 of left body section 206 is pivotally attached to left bushing 268 of mounting plate 202. Right first socket 240 of right body section 208 is pivotally attached to right bushing 270 of mounting plate 202. Thus attached, it can be seen that there is clearance between the inside of left bushing 268 and the inside of right bushing 270 such that hydraulic cylinder assembly 204 can rotate freely to a position between them without mechanical interference. This permits a greater angular deployment, and thus convenient utilization of breaker assembly 201.

Figure 15:
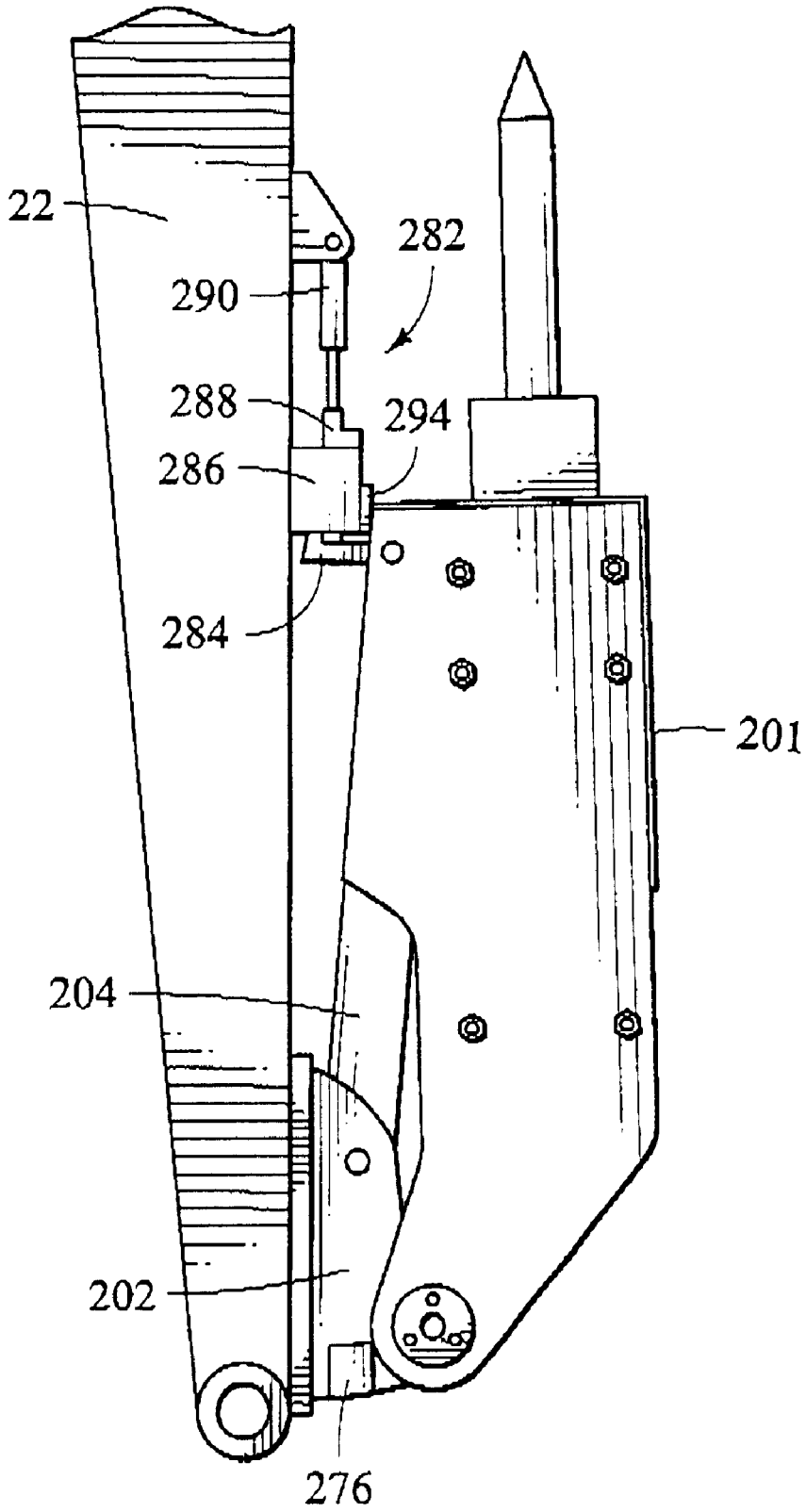
FIG. 15 is a side view of the preferred embodiment of the breaker and deployment system shown attached to the boom stick of an excavating machine, with a breaker assembly in the fully retracted and latched closed.

FIG. 15 is a side view of a preferred embodiment of breaker and deployment system 200 attached to boom stick 22 of excavating machine 10, with breaker assembly 201 in the fully retracted position. A shock absorbing retraction stop 280 is attached between boom stick 22 and breaker assembly 201. Retraction stop 280 prevents damage to breaker assembly 201, hydraulic cylinder 204, and boom stick 22 when breaker 201 is in the stowed position, encountering vibration and impact forces during operation of bucket 36. In the embodiment shown, retraction stop 280 is attached to boom stick 22. In an alternative and equivalent embodiment, not shown, retraction stop 280 is attached to breaker assembly 201.

Also disclosed in FIG. 15, a latch-lock assembly 282 is mounted to, and between, boom stick 22 and breaker assembly 201. Latch-lock assembly 282 secures breaker and deployment system 200 in the retracted position, preventing undesired partial deployment of breaker assembly 201 from the vibration and impact forces encountered during operation of bucket 36. As shown, latch-lock assembly includes a strike 284 located on breaker assembly 201. In the preferred embodiment, latch-lock 282 is operable from within cab 16 of excavating machine 10. Operation of latch-lock assembly 282 may be electrically, manually, pneumatically, or hydraulically.

Figure 16:
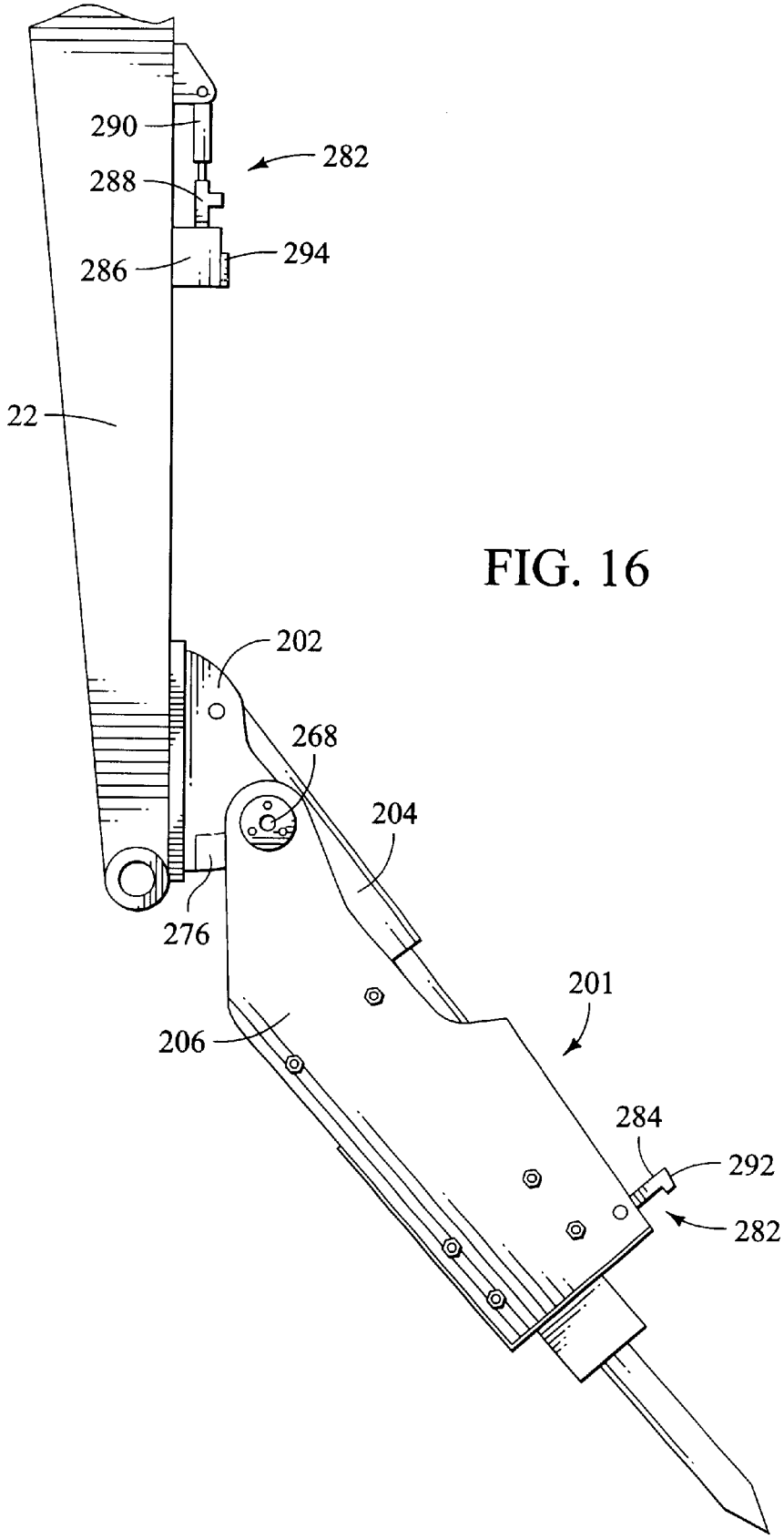
FIG. 16 is a side view of the preferred embodiment of the breaker system of FIG. 15, with the breaker system unlatched and in a fully extended and stopped position.

FIG. 16 is a side view of a preferred embodiment of breaker and deployment system 200 attached to boom stick 22 of excavating machine 10, with breaker assembly 201 in the fully extended and stopped position. In this view, extension stop 276 has engaged left body section 206, preventing further angular rotation (extension) of breaker assembly 201. In the preferred embodiment, a second extension stop 276 has simultaneously engaged right body section 208 on the opposite side, and not visible in this view.

Figure 17:
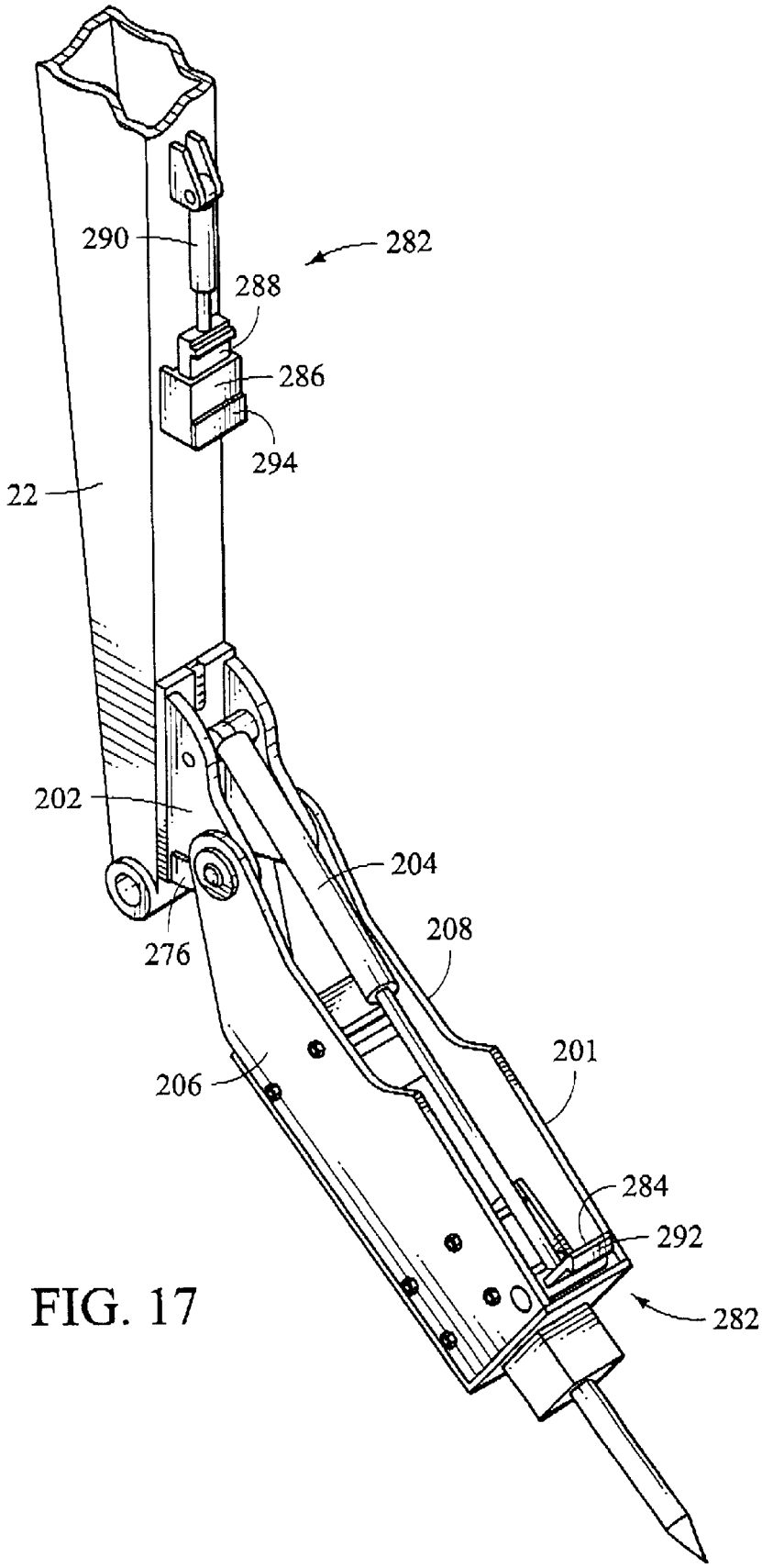
FIG. 17 is an isometric view of the preferred embodiment of the breaker system of FIGS. 15 and 16, with the breaker system shown in a fully extended and stopped position.

FIG. 17 is an isometric view of the preferred embodiment of breaker and deployment system 200 of FIG. 16, with breaker and deployment system 200 shown in a fully extended and stopped position. In this view, it can be seen there is clearance between the inside of left bushing 268 and the inside of right bushing 270 such that hydraulic cylinder assembly 204 can rotate freely to a position between them without mechanical interference. This permits a greater angular deployment, and thus convenient utilization of breaker assembly 201.

Also seen in FIG. 17, is further detail of a preferred embodiment of latch-lock assembly 282. In this embodiment, latch assembly 282 has a guide box 286 attached to the underside of boom stick 22. A slide latch 288 is slidably located within guide box 286. A control piston 290 is electrically, manually, pneumatically, or hydraulically operated from within cab 16 of excavating machine 10 to alternately move slide latch 288 between an engagement and release position with strike 284. In a preferred embodiment, strike 284 has a beveled face 292 for contact engagement with slide latch 288. In another preferred embodiment, guide box 286 has a reinforcement plate 294 to prevent deformation of guide box 286 and undesired release of breaker assembly 201.

Figure 18:
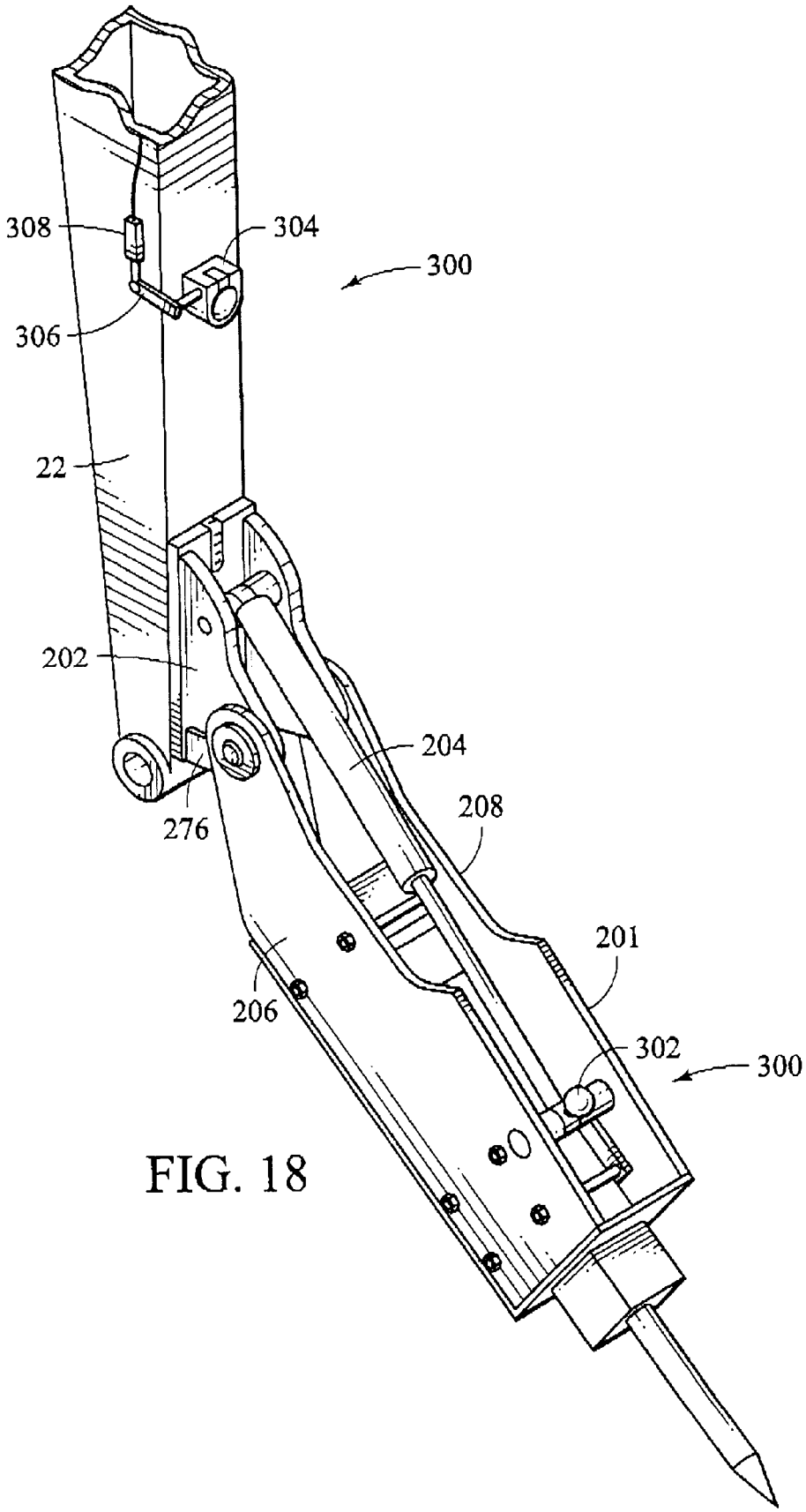
FIG. 18 is an isometric view of the preferred embodiment of the breaker system of FIG. 17, disclosing an alternative latch-lock assembly.

FIG. 18 is an isometric view of the preferred embodiment of the breaker system of FIGS. 15–17, with the breaker system shown in a fully extended and stopped position, and disclosing an alternative latch-lock assembly 300. In this embodiment, a strike ball 302 is located on breaker assembly 201. In a preferred embodiment, strike ball 302 is welded or otherwise attached to the end of hydraulic cylinder 204. A ball latch 304 is attached to boom stick 22. Ball latch 304 is releasably operated by arm 306. Release 308 actuates arm 306 and is electrically, manually, pneumatically, or hydraulically operated from within cab 16 of excavating machine 10. A spring 310 (not shown) located within ball latch 304 urges ball latch 304 closed, and receivable of strike ball 302 upon subsequent retraction of breaker assembly 201.

Figure 19:
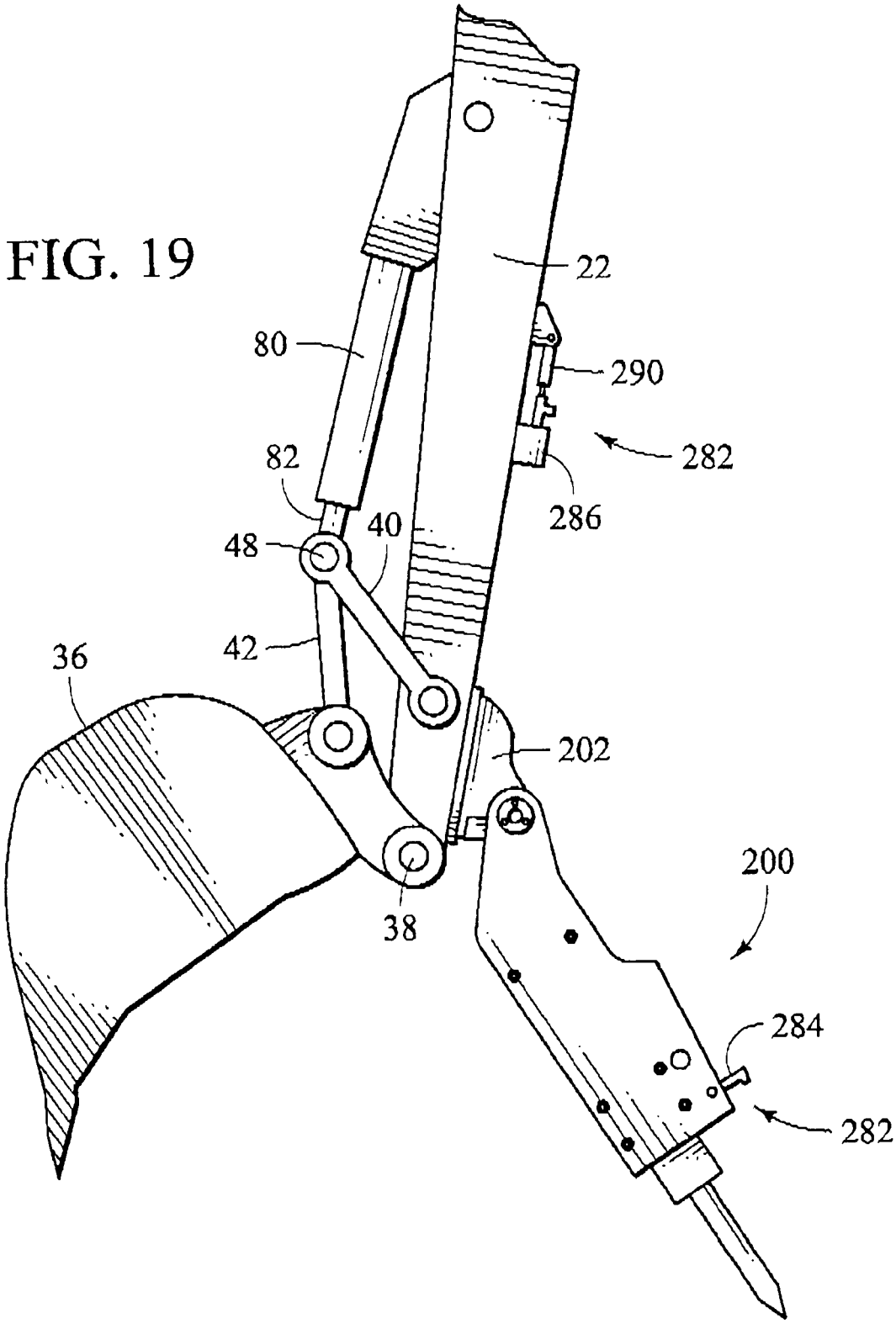
FIG. 19 is a side view of a preferred embodiment of a gravity deployment system of the present invention, showing the breaker on an excavating machine in the extended position.
Figure 20:
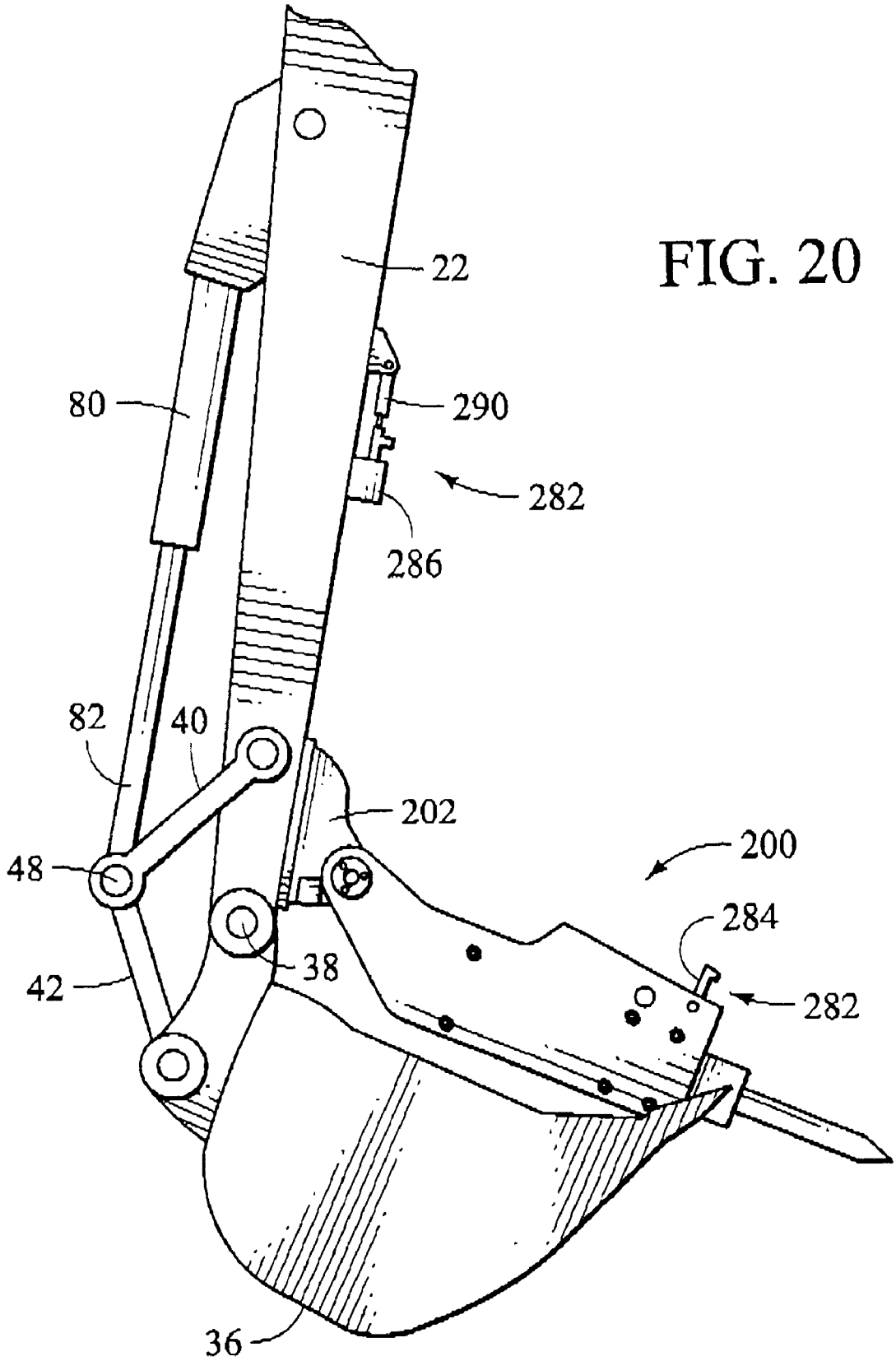
FIG. 20 is a side view of the preferred embodiment of the gravity deployment system of FIG. 19, showing the relationship between the bucket, the breaker, and the boom stick, as the bucket is retracted to retract the gravity deployed breaker.
Figure 21:
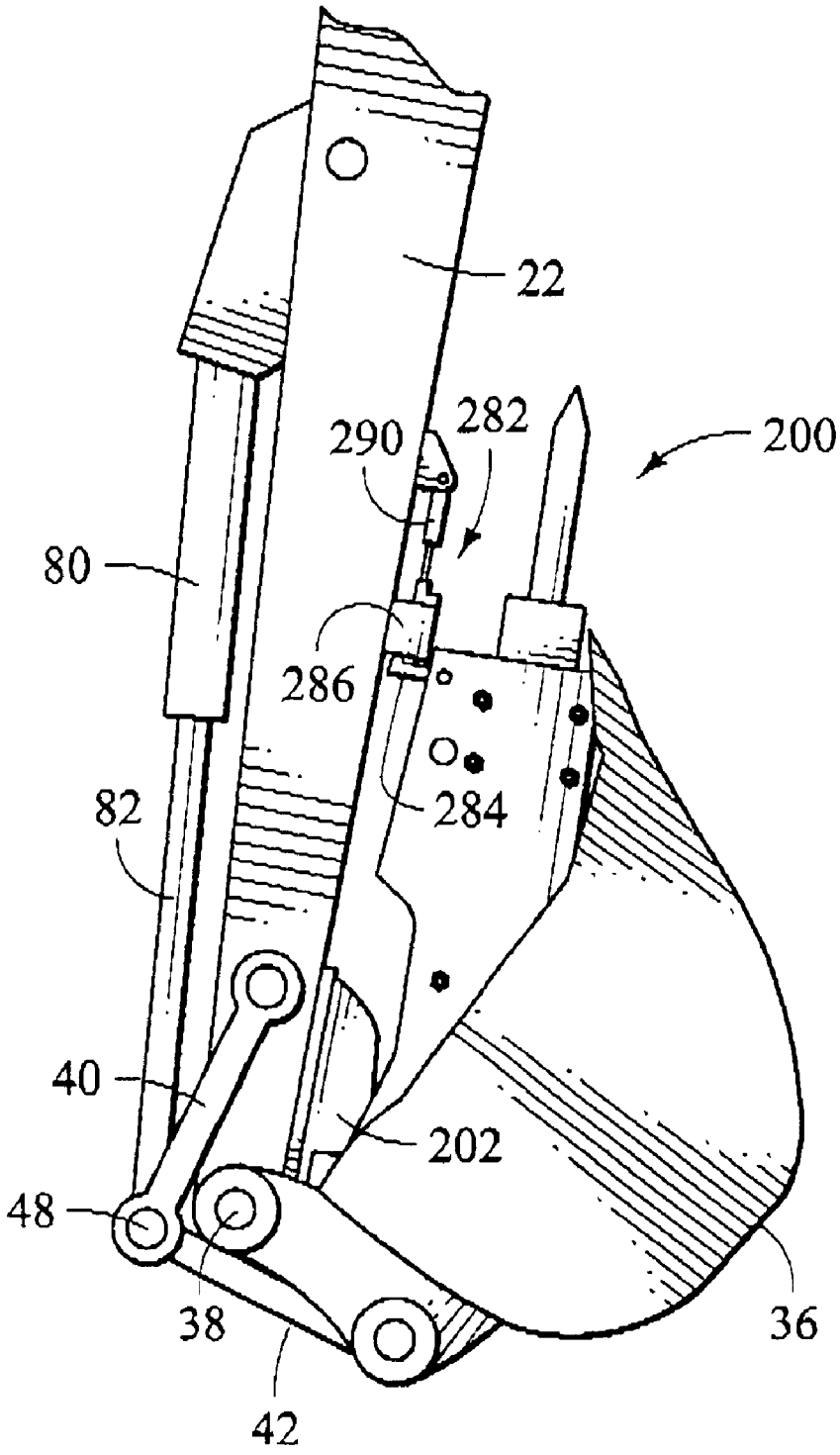
FIG. 21 is a side view of the preferred embodiment of the gravity deployment system of FIGS. 19 and 20, showing complete retraction and latching of the breaker by retraction of the bucket.

FIGS. 19, 20 and 21 are side views of a preferred embodiment of an alternative gravity deployment system, showing the relationship between bucket 36, breaker assembly 201, and boom stick 22. In this embodiment, bucket 36 is retracted to retract the gravity deployed breaker assembly 201. The advantage of this embodiment is that it can be incorporated onto excavating machine 10 without a requirement for hydraulic cylinder 204 or hydraulic/electric circuit 70 to selectively pivot bucket 36 and breaker assembly 201. FIG. 21 is a side view of the preferred embodiment of the gravity deployment system of FIGS. 19 and 20, showing complete retraction and latching of breaker assembly 201 by retraction of bucket 36.

The foregoing detailed description is to be clearly understood as being given by way of illustration and example, the spirit and scope of the present invention being limited solely by the appended claims.

What is claimed is:

1. An excavating machine, comprising:

a body;

a boom structure extending outwardly from the body and including a pivotable boom stick;

a first excavating tool pivotally secured to the boom stick;

a bracket attached to the underside of the boom stick, the bracket having a first pivot, and a second pivot;

a second excavating tool pivotally secured at one end to the first pivot, and having a third pivot located thereon between the one end and its opposite end;

a hydraulic cylinder pivotally secured at one end to the second pivot, and pivotally secured on its opposite end to the third pivot;

whereas the distance between the first pivot and the second pivot is less than the distance between the first pivot and the third pivot.

2. The excavating machine of claim 1 wherein said excavating machine is a tracked excavator.

3. The excavating machine of claim 1 wherein said first excavating tool is an excavating bucket.

4. The excavating machine of claim 1 wherein said second excavating tool is a breaker.

5. The boom stick assembly of claim 1, further comprising:

a latch-lock assembly mounted to and between the boom stick and the breaker; and, a latch-lock release located in the cab portion of the excavating machine.

6. The boom stick assembly of claim 5, wherein the latch-lock assembly further comprises:

a guide box attached to the boom stick;

a slide latch, slidably located within the gate box;

a control piston connected to the slide latch, and being operable to forcibly move the slide latch alternately between an engagement and release position;

a strike attached to the breaker assembly; and, whereas the strike is engageable with the slide latch when the breaker is in the retracted position.

7. The boom stick assembly of claim 6, wherein the latch-lock assembly further comprises:

a beveled face on the strike.

8. The boom stick assembly of claim 6, wherein the latch-lock assembly further comprises:

a reinforcement plate attached to the guide box.

9. The boom stick assembly of claim 1, further comprising:

a shock absorbing retraction stop attached to the boom stick.

10. The boom stick assembly of claim 1, further comprising:

a shock absorbing retraction stop attached to the second excavating tool.

11. The excavating machine of claim 1, further comprising:

an extension stop attached to the bracket, and being engagable with the second excavation tool upon a full extension of the second excavation tool.

12. The excavating machine of claim 1, further comprising:

an extension-lock assembly attached to the bracket.

13. The excavating machine of claim 1, further comprising:

whereas when the second excavating tool is in a fully retracted position, the second pivot lies substantially between the first pivot and the third pivot.

14. An excavating machine, comprising:

a body;

a boom structure extending outwardly from the body and including a pivotable boom stick;

an excavating bucket pivotally secured to the boom stick;

a bracket attached to the underside of the boom stick, the bracket having a first pivot, and a second pivot;

a breaker pivotally secured at one end to the first pivot, and having a third pivot located thereon between the one end and its opposite end; and, a hydraulic cylinder pivotally secured at one end to the second pivot, and pivotally secured on its opposite end to the third pivot.

15. The boom stick assembly of claim 14, further comprising:

whereas the distance between the first pivot and the second pivot is less than the distance between the first pivot and the third pivot.

16. A boom stick assembly for use on an excavating machine, comprising:

a boom stick;

a first excavating tool pivotally secured to the boom stick;

a bracket attached to the underside of the boom stick, the bracket having a first pivot, and a second pivot;

a second excavating tool pivotally secured at one end to the first pivot, and having a third pivot located thereon between the one end and its opposite end;

a hydraulic cylinder pivotally secured at one end to the second pivot, and pivotally secured on its opposite end to the third pivot; and, whereas the distance between the first pivot and the second pivot is less than the distance between the first pivot and the third pivot.

17. The boom stick assembly of claim 16, further comprising:

whereas when the second excavating tool is in a stowed position, the second pivot lies substantially between the first pivot and the third pivot.

18. An excavating tool system for use on an excavating machine, comprising:

a bracket attachable to the underside of a boom stick, the bracket having a first pivot, and a second pivot;

an excavating tool pivotally secured at one end to the first pivot, and having a third pivot located thereon between the one end and its opposite end;

a hydraulic cylinder pivotally secured at one end to the second pivot, and pivotally secured on its opposite end to the third pivot; and, whereas the distance between the first pivot and the second pivot is less than the distance between the first pivot and the third pivot.

19. The excavating tool system of claim 18, further comprising:

whereas the excavating tool is a breaker assembly.

20. The excavating tool system of claim 19, wherein the breaker assembly further comprises:

a left body section having a first socket located on one end, and having a third socket proximate to its other end;

a right body section having a first socket located on one end, and having a third socket proximate to its other end;

a hydraulic breaker tool mechanically secured between the left body section and the right body section;

a reciprocating tool removably connectable to the breaker tool; and a pivot bushing attachable to a hydraulic cylinder, the pivot bushing attached in and between the third sockets of left body section and right body section.

21. The excavating tool system of claim 19, wherein the breaker assembly further comprises:

a pair of upper lock plates securing the inner end of the breaker tool between the left body section and the right body section; and, a pair of lower lock plates securing the outer end of the breaker tool between the left body section and the right body section.

22. The excavating tool system of claim 18, further comprising:

whereas the excavating tool is selectively positionable between, and including, fully deployed and fully retracted positions.

23. The excavating tool system of claim 18, wherein the pivotal attachment of the excavating tool to the bracket is bifurcated.

24. The excavating tool system of claim 18, wherein the bracket further comprises;

a base;

a left bracket side extending upward from the base, and having a first socket and a second socket; and, a right bracket side extending upward from the base, and having a first socket in substantial centerline alignment with the first socket of the left bracket side, and having a second socket in substantial centerline alignment with the second socket of the left bracket side.

25. The excavating tool system of claim 24, further comprising;

whereas the centerline of the second sockets is located closer to the base than is the centerline of the first sockets.

26. The excavating tool system of claim 24, further comprising;

a left bushing removably located in, and extending outwardly from the first socket of the left bracket side; and, a right bushing removably located in, and extending outwardly from the first socket of the right bracket side.

27. The excavating tool system of claim 26, further comprising;

an internal thread located on one end of each of the right bushing and the left bushing.

28. The excavating tool system of claim 18, further comprising:

a latch-lock assembly mounted to and between the boom stick and the second excavating tool; and, a latch-lock release located in a cab portion of the excavating machine.

* * * * *